US012735975B2

(12) United States Patent
Chen et al.

(10) Patent No.: US 12,735,975 B2
(45) Date of Patent: Sep. 15, 2026

(54) SYSTEMS AND METHODS FOR TORQUE AND DRAG ANALYSIS OF DOWNHOLE SYSTEMS

(71) Applicant: Schlumberger Technology Corporation, Sugar Land, TX (US)

(72) Inventors: Rongbing Chen, Beijing (CN); Gang Xu, Beijing (CN); Ji Tang Liu, Beijing (CN); Jianjun Yang, Beijing (CN)

(73) Assignee: Schlumberger Technology Corporation, Sugar Land, TX (US)

( * ) Notice: Subject to any disclaimer, the term of this patent is extended or adjusted under 35 U.S.C. 154(b) by 328 days.

(21) Appl. No.: 18/432,369

(22) Filed: Feb. 5, 2024

(65) Prior Publication Data

US 2025/0250892 A1 Aug. 7, 2025

(51) Int. Cl.
*E21B 44/04* (2006.01)

(52) U.S. Cl.
CPC ..... *E21B 44/04* (2013.01); *E21B 2200/20* (2020.05)

(58) Field of Classification Search
None
See application file for complete search history.

(56) References Cited

U.S. PATENT DOCUMENTS

| | | | | |
|---|---|---|---|---|
| 10,900,341 | B2 * | 1/2021 | Brannigan | G06F 18/22 |
| 11,725,493 | B2 * | 8/2023 | Pietrzyk | E21B 44/00 702/9 |
| 2015/0345239 | A1 | 12/2015 | Samuel et al. | |
| 2017/0022798 | A1 | 1/2017 | Samuel et al. | |
| 2018/0238165 | A1 | 8/2018 | Samuel | |

OTHER PUBLICATIONS

International Search Report and Written Opinion of International Patent Application No. PCT/US2024/014561 dated on Sep. 20, 2024, 10 pages.

* cited by examiner

*Primary Examiner* — Elias Desta
(74) *Attorney, Agent, or Firm* — Kyle R. Miiller

(57) ABSTRACT

A method of analyzing torque and drag of a drill string in a wellbore includes receiving wellbore data including a trajectory of the wellbore, and receiving drill string data for the drill string, at least a portion of the drill string including an inner string positioned inside of the drill string. The method includes generating a virtual wellbore associated with the inner string based on an inner diameter of the drill string and based on the trajectory of the wellbore, and determining a set of inner forces for the inner string including an axial force based on the weight of the inner string and a set of contact forces between the inner string and the virtual wellbore. The method includes identifying a set of normal forces between the drill string and the wellbore based on simulating the inner forces as applied forces to the drill string.

15 Claims, 14 Drawing Sheets

SYSTEMS AND METHODS FOR TORQUE AND DRAG ANALYSIS OF DOWNHOLE SYSTEMS

BACKGROUND OF THE DISCLOSURE

Wellbores may be drilled into a surface location or seabed for a variety of exploratory or extraction purposes. For example, a wellbore may be drilled to access fluids, such as liquid and gaseous hydrocarbons, stored in subterranean formations and to extract the fluids from the formations. Wellbores used to produce or extract fluids may be formed in earthen formations using earth-boring tools such as drill bits for drilling wellbores and reamers for enlarging the diameters of wellbores.

Drill strings implemented in wellbores experience various forces, torques, and other dynamics as they are subject to the downhole environment. Torque and drag analysis is typically performed to understand various dynamics experienced by the drill strings, such as tension within the drill string, torque on the drill string, and frictional forces resisting rotational and axial motion of the drill string, among others. In some cases, drill strings are implemented which exhibit multiple, nested layers at one or more locations, such as an inner string positioned within and extending through a liner string. The multi-layer nature of such drill strings presents a very complex problem for determining torque and drag, and many conventional techniques are inadequately equipped to handle such problems. For example, some techniques may simply not account for inner string dynamics and may fall short by attempting to analyze the system as a single-layer drill string. Other techniques may attempt to define and account for all of the complexities of the interactions between the layers by constructing an intricate, global model representing both the inner string and liner string. These systems, however, may be highly complex to accurately model, and even so may be computationally difficult to solve, often involving a high level of non-linearity and non-convergence. Thus, systems and methods for determining torque and drag for multi-layer drill strings may be advantageous.

SUMMARY

In some embodiments, a method of analyzing torque and drag of a drill string in a wellbore includes receiving wellbore data including a trajectory of the wellbore at a range of measurement depths of interest. The method further includes receiving drill string data for the drill string, at least a portion of the drill string including an inner string positioned inside of the drill string. The method further includes generating a virtual wellbore associated with the inner string based on an inner diameter of the drill string and based on the trajectory of the wellbore. The method further includes determining a set of inner forces for the inner string including an axial force based on the weight of the inner string and a set of contact forces between the inner string and the virtual wellbore. The method further includes identifying a set of normal forces between the drill string and the wellbore based on simulating the axial force and the set of contact forces as applied forces to the drill string. In some embodiments, the method is performed by a system. In some embodiments, the method is implemented as instructions stored on a computer-readable storage medium.

This summary is provided to introduce a selection of concepts that are further described in the detailed description. This summary is not intended to identify key or essential features of the claimed subject matter, nor is it intended to be used as an aid in limiting the scope of the claimed subject matter. Additional features and aspects of embodiments of the disclosure will be set forth herein, and in part will be obvious from the description, or may be learned by the practice of such embodiments.

BRIEF DESCRIPTION OF THE DRAWINGS

In order to describe the manner in which the above-recited and other features of the disclosure may be obtained, a more particular description will be rendered by reference to specific embodiments thereof which are illustrated in the appended drawings. For better understanding, the like elements have been designated by like reference numbers throughout the various accompanying figures. While some of the drawings may be schematic or exaggerated representations of concepts, at least some of the drawings may be drawn to scale. Understanding that the drawings depict some example embodiments, the embodiments will be described and explained with additional specificity and detail through the use of the accompanying drawings in which:

FIGS. 4-1 and 4-2 is a schematic illustration of an example drill string having an inner string and an outer, liner string, according to at least one embodiment of the present disclosure;

FIG. 4-3 illustrates a conventional technique for torque and drag analysis of a multi-layer drill string, according to at least one embodiment of the present disclosure;

FIGS. 6-1, 6-2, and 6-3 are schematic representations illustrating an example partitioning of a drill string, according to at least one embodiment of the present disclosure;

FIG. 8-1 illustrates an example report for torque and drag analysis of a multi-layer drill string with respect to a vertical wellbore, according to at least one embodiment of the present disclosure;

FIG. 8-2 illustrates an example report for torque and drag analysis of a multi-layer drill string with respect to a wellbore having an incline, according to at least one embodiment of the present disclosure;

DETAILED DESCRIPTION

This disclosure generally relates to systems and methods for torque and drag analysis of downhole systems. In many cases, such as with offshore wellbores, drill strings may be implemented that have multiple layers, such as an inner string inside of a liner string. Traditional techniques for performing torque and drag analysis, such as modeling the entire multi-layer system using finite element analysis (FEA) models, may be inadequately equipped to accurately and efficiently handle such problems. For example, the interaction between the inner string and the liner string may be very nuanced, and accurately capturing the complexities of relationship between these two layers may be difficult to represent in a complete, global model that includes both the inner string and the liner string. Thus, characterizing and solving such a complex system, which may involve a high level of non-linearity, may be computationally demanding, and prone to inaccuracies.

A torque and drag system according to the present disclosure may provide advantages over these conventional techniques and may be better suited to handle multi-layer drill string problems. For example, the torque and drag system may analyze the layers of the drill string separately by partitioning the inner string from the liner string. Based on the liner string inner diameter and the wellbore trajectory, the torque and drag system generates a virtual wellbore in which the inner string in positioned. By defining an isolated system for the inner string, the torque and drag system may determine various forces and other dynamics acting on the inner string based on the interaction of the inner string with the virtual wellbore. In this way, the interaction of the inner string and the liner string is simulated based on solving a single-layer FEA model for the inner string.

The torque and drag system may then define a system for the liner string (and associated landing string) without the inner string. Based on the analysis of the inner string, axial forces and contact forces of the inner string are incorporated as applied external forces to the liner string. In this way, the liner string (and landing string) may be represented by analyzing and solving an additional single-layer FEA model, and the interaction of the inner string with the liner string may be incorporated into this model by applying the determined forces from the inner string model. Thus, the torque and drag system described herein is better equipped to accurately handle double-layer drill string problems based on partitioning the layers and relating them together through generation of the virtual wellbore. In this way, the torque and drag system may still capture the complex relationship between the two layers with high accuracy but may do so by defining and solving more manageable, single-layer FEA models that are less complex, have less non-linearity, and less convergence issues.

Figure 1:
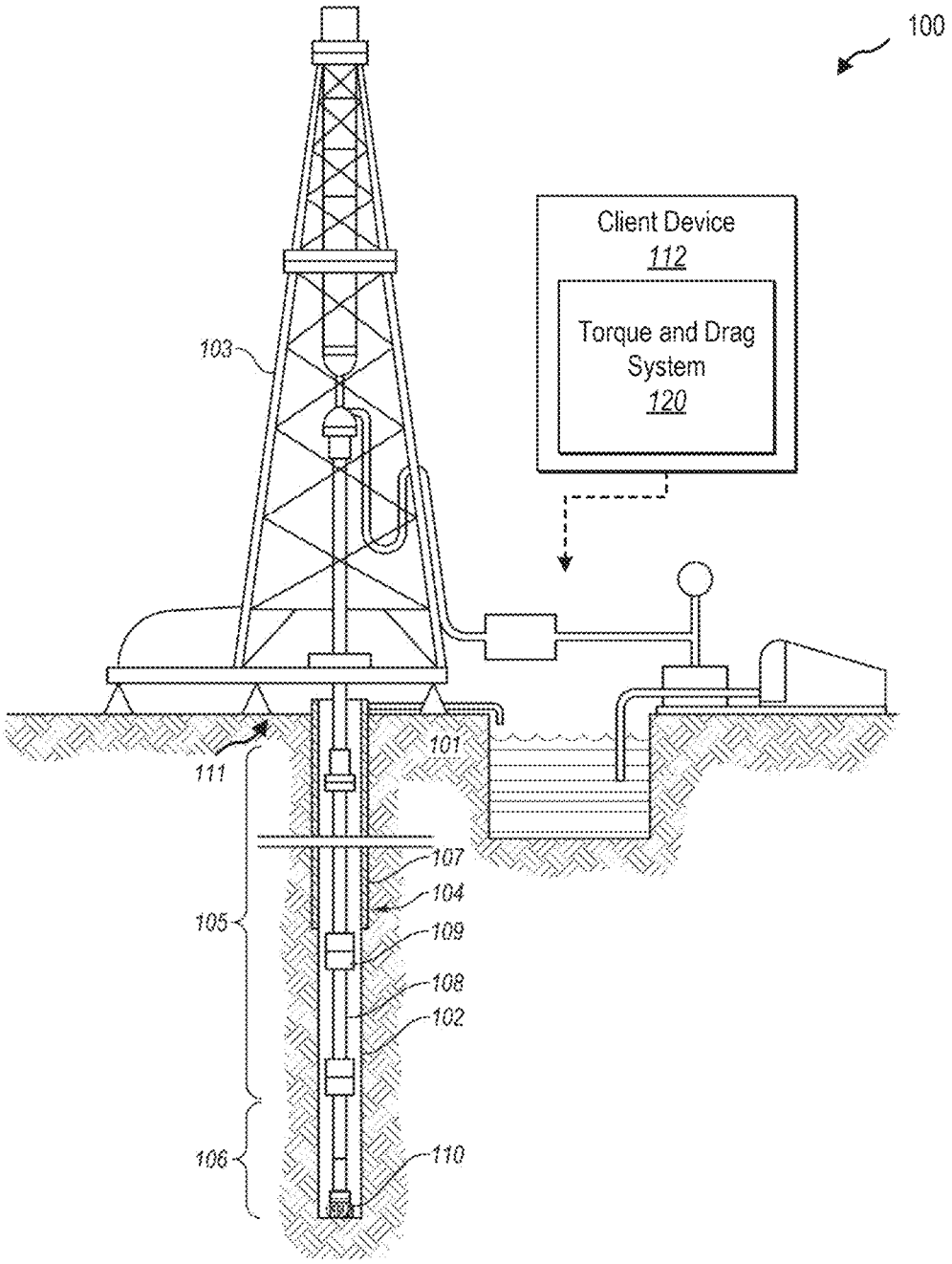
FIG. 1 is an example of a downhole system, according to at least one embodiment of the present disclosure.

Additional details will now be provided regarding systems described herein in relation to illustrative figures portraying example implementations. For example, FIG. 1 shows one example of a downhole system 100 for drilling an earth formation 101 to form a wellbore 102. The downhole system 100 includes a drill rig 103 used to turn a drilling tool assembly 104 which extends downward into the wellbore 102. The drilling tool assembly 104 may include a drill string 105, a bottomhole assembly ("BHA") 106, and a bit 110, attached to the downhole end of the drill string 105.

The drill string 105 may include several joints of drill pipe 108 connected end-to-end through tool joints 109. The drill string 105 transmits drilling fluid through a central bore and transmits rotational power from the drill rig 103 to the BHA 106. In some embodiments, the drill string 105 further includes additional downhole drilling tools and/or components such as subs, pup joints, etc. The drill pipe 108 provides a hydraulic passage through which drilling fluid is pumped from the surface 111. The drilling fluid discharges through selected-size nozzles, jets, or other orifices in the bit 110 for the purposes of cooling the bit 110 and cutting structures thereon, and for lifting cuttings out of the wellbore 102 as it is being drilled.

The BHA 106 may include the bit 110, other downhole drilling tools, or other components. An example BHA 106 may include additional or other downhole drilling tools or components (e.g., coupled between to the drill string 105 and the bit 110). Examples of additional BHA components include drill collars, stabilizers, measurement-while-drilling ("MWD") tools, logging-while-drilling ("LWD") tools, downhole motors, underreamers, section mills, hydraulic disconnects, jars, vibration or dampening tools, other components, or combinations of the foregoing.

In general, the downhole system 100 may include other downhole drilling tools, components, and accessories such as special valves (e.g., kelly cocks, blowout preventers, and safety valves). Additional components included in the downhole system 100 may be considered a part of the drilling tool assembly 104, the drill string 105, or a part of the BHA 106, depending on their locations in the downhole system 100.

The bit 110 in the BHA 106 may be any type of bit suitable for degrading downhole materials. For instance, the bit 110 may be a drill bit suitable for drilling the earth formation 101. Example types of drill bits used for drilling earth formations are fixed-cutter or drag bits. In other embodiments, the bit 110 may be a mill used for removing metal, composite, elastomer, other materials downhole, or combinations thereof. For instance, the bit 110 may be used with a whipstock to mill into casing 107 lining the wellbore 102. The bit 110 may also be a junk mill used to mill away tools, plugs, cement, other materials within the wellbore 102, or combinations thereof. Swarf or other cuttings formed by use of a mill may be lifted to the surface 111 or may be allowed to fall downhole. The bit 110 may include one or more cutting elements for degrading the earth formation 101.

The BHA 106 may further include a rotary steerable system (RSS). The RSS may include directional drilling tools that change a direction of the bit 110, and thereby the trajectory of the wellbore. At least a portion of the RSS may maintain a geostationary position relative to an absolute reference frame, such as one or more of gravity, magnetic north, or true north. Using measurements obtained with the geostationary position, the RSS may locate the bit 110, change the course of the bit 110, and direct the directional drilling tools on a projected trajectory. The RSS may steer the bit 110 in accordance with or based on a trajectory for the bit 110. For example, a trajectory may be determined for directing the bit 110 toward one or more subterranean targets such as an oil or gas reservoir.

The downhole system 100 may include or may be associated with one or more client devices 112 with a torque and drag (T&D) system 120 implemented thereon (e.g., implemented on one, several, or across multiple client devices 112). The T&D system 120 may facilitate calculating and/or assessing forces and/or other parameters that may act on the drill string in association with the drill string advancing into or being retrieved from the wellbore 102.

Figure 2:
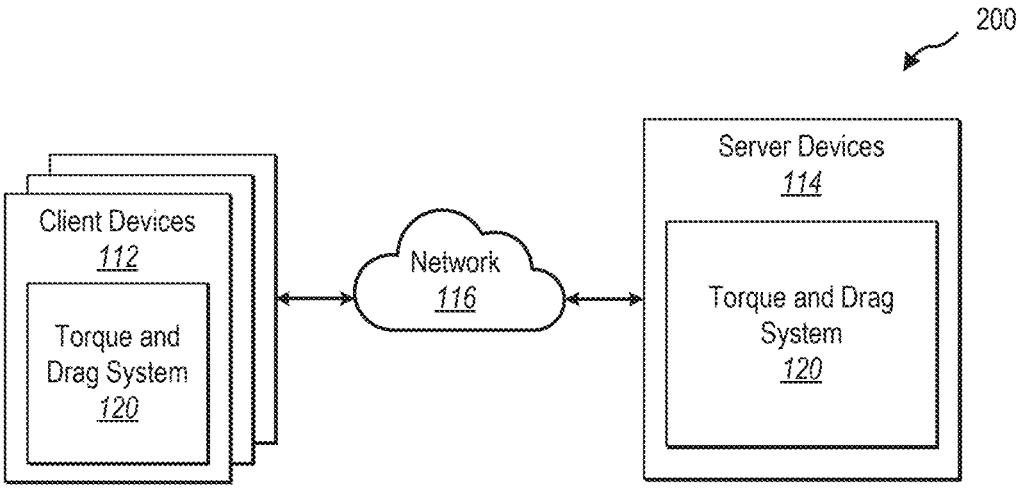
FIG. 2 illustrates an example environment in which a torque and drag system is implemented, according to at least one embodiment of the present disclosure.

FIG. 2 illustrates an example environment 200 in which a T&D system 120 is implemented in accordance with one or more embodiments describe herein. As shown in FIG. 2, the environment 200 includes one or more server device(s) 114. The server device(s) 114 may include one or more computing devices (e.g., including processing units, data storage, etc.) organized in an architecture with various network interfaces for connecting to and providing data management and distribution across one or more client systems. As shown in FIG. 2, the server devices 114 may be connected to and may communicate with (either directly or indirectly) one or more client devices 112 through a network 116. The network 116 may include one or multiple networks and may use one or more communication platforms and/or technologies suitable for transmitting data. The network 116 may refer to any data link that enables transport of electronic data between devices of the environment 200. The network 116 may refer to a hardwired network, a wireless network, or a combination of a hardwired network and a wireless network. In one or more embodiments, the network 116 includes the internet. The network 116 may be configured to facilitate communication between the various computing devices via well-site information transfer standard markup language (WITSML) or similar protocol, or any other protocol or form of communication.

The client device 112 may refer to various types of computing devices. For example, one or more client devices 112 may include a mobile device such as a mobile telephone, a smartphone, a personal digital assistant (PDA), a tablet, a laptop, or any other portable device. Additionally, or alternatively, the client devices 112 may include one or more non-mobile devices such as a desktop computer, server device, surface or downhole processor or computer (e.g., associated with a sensor, system, or function of the downhole system), or other non-portable device. In one or more implementations, the client devices 112 include graphical user interfaces (GUI) thereon (e.g., a screen of a mobile device). In addition, or as an alternative, one or more of the client devices 112 may be communicatively coupled (e.g., wired or wirelessly) to a display device having a graphical user interface thereon for providing a display of system content. The server device(s) 114 may similarly refer to various types of computing devices. Each of the devices of the environment 200 may include features and/or functionalities described below in connection with FIG. 10.

As shown in FIG. 2, the environment 200 may include a T&D system 120 implemented on one or more computing devices. The T&D system 120 may be implemented on one or more client device 112, server devices 114, and combinations thereof. Additionally, or alternatively, the T&D system 120 may be implemented across the client devices 112 and/or the server devices 114 such that different portions or components of the T&D system 120 are implemented on different computing devices in the environment 200. In this way, the environment 200 may be a cloud computing environment, and the T&D system 120 may be implemented across one or more devices of the cloud computing environment in order to leverage the processing capabilities, memory capabilities, connectivity, speed, etc., that such cloud computing environments offer in order to facilitate the features and functionalities described herein.

Figure 3:
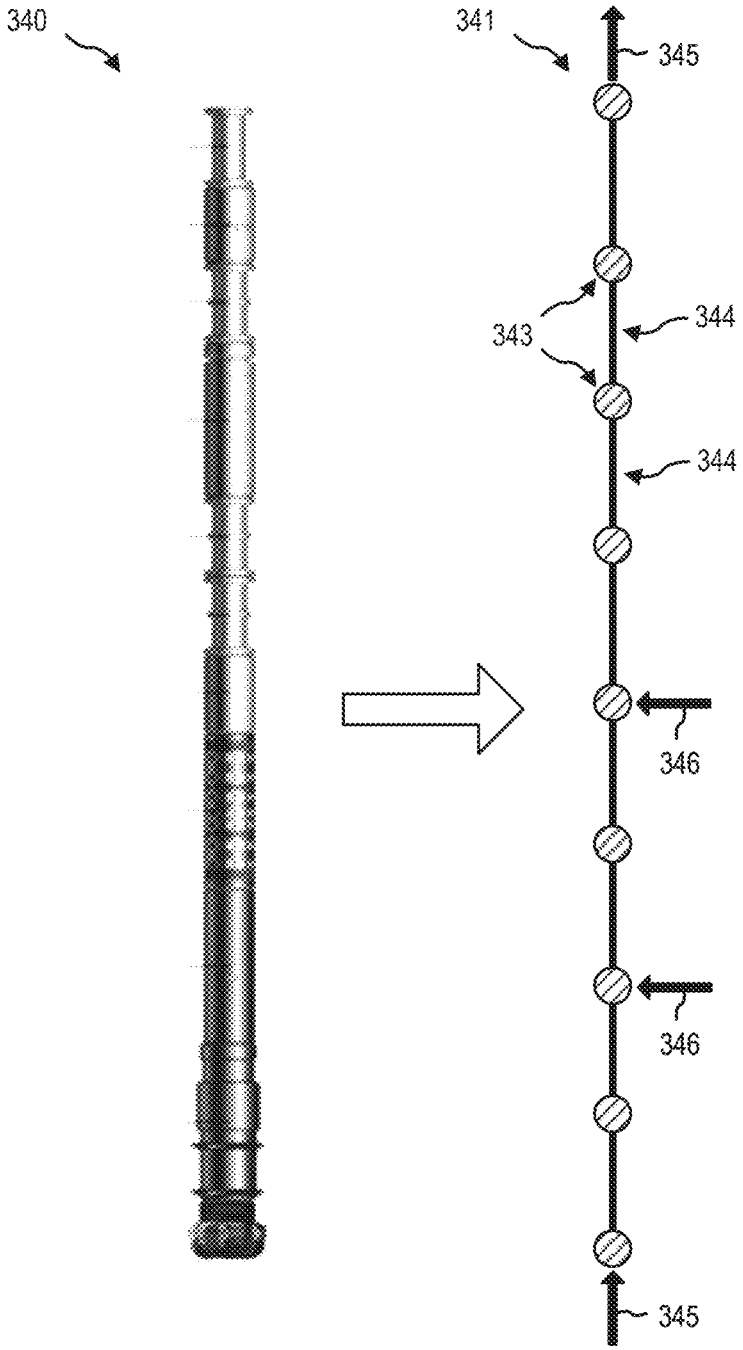
FIG. 3 illustrates a conventional technique for torque and drag analysis of a drill string, according to at least one embodiment of the present disclosure.

FIG. 3 illustrates a conventional technique for torque and drag (T&D) analysis of a drill string 340. As shown, the drill string 340 may include one or more sections, components, and/or downhole tools. The drill string 340 may be implemented (or planned to be implemented) in a wellbore. In many cases, wellbores may be deviated and may exhibit curvature and tortuosity to various degrees. Drill strings may typically be at least somewhat rigid at one or more locations and thus may bend and deform in order to traverse certain portions of a deviated wellbore. Additionally, contact of the drill string with the wellbore may result in frictional resistance to the movement, both rotational and axial, of the drill string in the wellbore. Accordingly, drill strings may experience various stresses, forces, twisting, bending, compression, and tension among other dynamics. Thus, it may be advantageous to determine and assess the dynamics acting on the drill string 340, for example, to ensure that one or more working or failure limits are not met or exceeded for one or more components of the drill string 340, and to prevent the drill string from becoming stuck at one or more locations in the wellbore. Determining, characterizing, and/or understanding the dynamics (e.g., forces, friction, torques, etc.) acting on a drill string is what is typically referred to as T&D drag analysis. Thus, while T&D analysis may typically involve determining the torque and/or drag (e.g., axial force) acting on a drill string, the analysis is not limited to only these dynamics and may include determining any other relevant dynamic of interest.

In many cases, T&D analysis may typically be performed by utilizing a finite element analysis (FEA) method. For example, the drill string 340 may be represented, converted, and/or approximated by an FEA model 341. As is known in the art, finite element modeling is a computational technique utilized to simulate and analyze the behavior of complex structures and systems. For example, based on the principles of discretization, a continuous object, such as the drill string 340, may be divided into a finite number of smaller, interconnected elements or segments. Each of these elements is defined by a set of mathematical equations, or shape functions, that describe its behavior under simulated, real-world conditions. Conventional techniques may leverage the FEA model 341 in order to perform T&D analysis.

For example, the FEA model 341 may be created by generating a mesh of the drill string 340. The drill string 340 may be divided into finite elements 344 of simple geometric shapes such as lines, triangles, quadrilaterals, tetrahedra, hexahedra, or other shapes. The elements 344 in FIG. 3 are shown to be 1 dimensional but may take any form such as 2-dimensional, 3-dimensional, and even higher-order elements, and combinations thereof. The generated mesh may also include nodes 343 connecting adjacent finite elements 344. The mesh of nodes 343 and finite elements 344 may typically be fine enough to capture the details, sections, tools, components, etc. of the drill string 340.

After the mesh is established, mathematical equations, or shape functions, are defined that govern and/or described the behavior of each element 344. These equations are derived based on physical principles and material properties of the drill string 340. For instance, the shape functions may be based on and/or related to stress, strain, and deformation of or within the finite elements 344. Interaction and/or movement of the nodes 343 may govern the shape functions, and therefore the shape functions of adjacent elements 344 may be coupled based on commonly shared nodes 343.

The shape functions may describe how the finite elements 344 respond to various loads, boundary conditions, forces, torques, and other dynamics applied to or experienced by the drill string 340. For example, each element 344 may be associated with properties, material characteristics, etc., of an associated portion of the drill string 340 in order to collectively represent the entire drill string 340.

As shown, the drill string 340 may be subject to various forces which may be incorporated into the FEA model 341. For instance, one or more axial loads 345 may be applied to the FEA model 341. The axial loads 345 may represent axial loading of the drill string 340, such as due to a weigh-on-bit of a downhole tool, a (e.g., suspended) weight of the drill string 340, a hook load applied by a drill rig, or any other applicable axial force. The axial loads 345 may be associated with stress and/or tension on or within the drill string. One or more lateral, normal, or contact forces 346 may be applied to the FEA model 341. The contact forces 346 may represent lateral or normal loading of the drill string 340, such as due to the drill string 340 contacting the wellbore wall at one or more locations (e.g., around a dogleg or bend). The contact forces 346 may influence the tension within the drill string 340, and may also result in frictional forces (e.g., torsional and axial) exerted on the drill string 340, such as when the drill string 340 is rotated within the wellbore, or tripped into or out of the wellbore.

Once defined, the shape functions may be assembled into a system of algebraic and/or differential equations that represent the entire global system of the FEA model 341. Using numerical techniques, the assembled system of equations may be solved to predict the response of the entire system under the specified conditions (e.g., under the applied loads, boundary conditions of the wellbore, etc.). An example shape function may be based on the following formula:

$$K \times U = F_g + F_{cnt}$$

where K=Stiffness of Pipe, U=Displacement of Pipe, $F_g$=Gravitational Force, and $F_{cnt}$=Contact Force Shape functions may be based on and/or may incorporate any other formula, principle, or expression. The FEA model 341 may simulate the rotational and/or axial movement of the drill string 340 within the wellbore by applying torques and/or forces and considering the mechanical connection between the various components/elements. Additionally, various parameters such as diameter, inclination, azimuth, material properties, etc., of the wellbore may be integrated into the FEA model 341 to simulate real-world conditions. By solving the system of equations, the deformation and stress distribution may be calculated within the drill string 340 for providing the torque and/or tension of the drill string 340 at different depths. Additionally, axial and/or torsional drag may be assessed by analyzing the axial forces acting on the drill string 340 as it moves through the wellbore, accounting for factors like wellbore geometry, trajectory, wellbore friction, gravity, buoyancy of the drilling fluid, etc. In this way, the FEA model 341 may capture complex behaviors of the drill string 340 such as buckling, helical deformation, and contact interactions with the wellbore wall in addition to tension and torque on/within the drill string 340.

Figures 1, 2, 4:
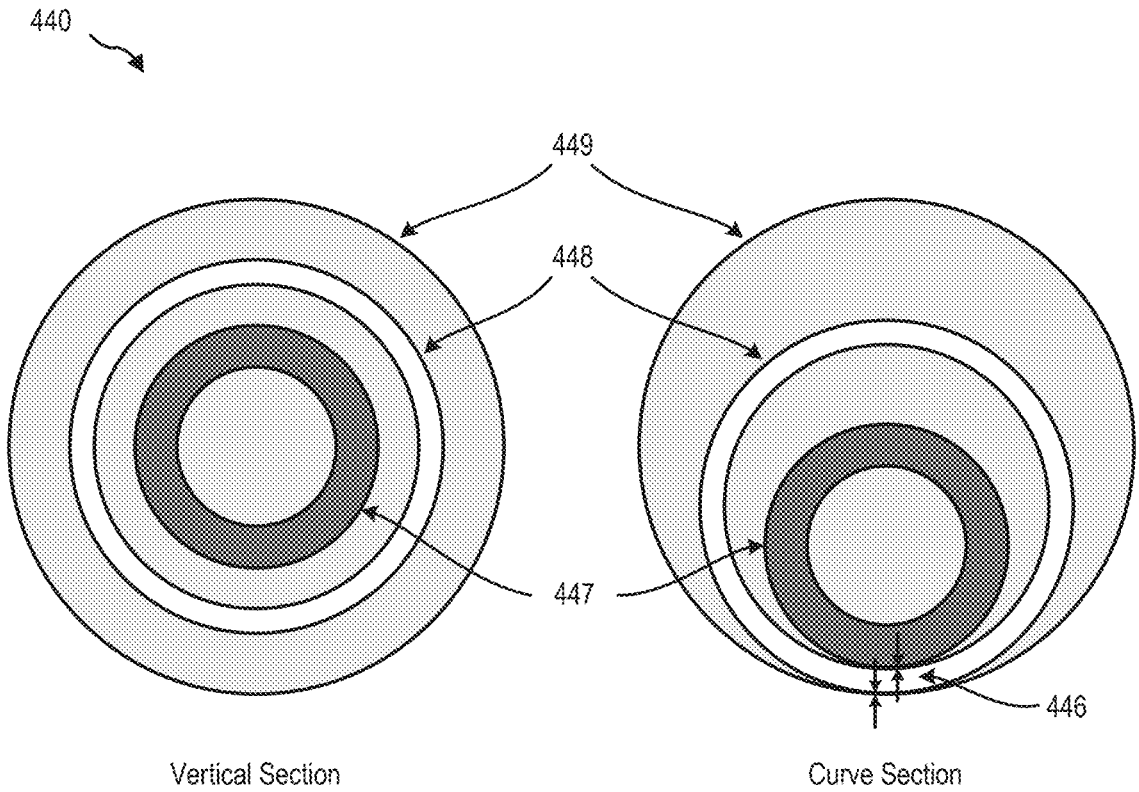
Figures 3, 4:
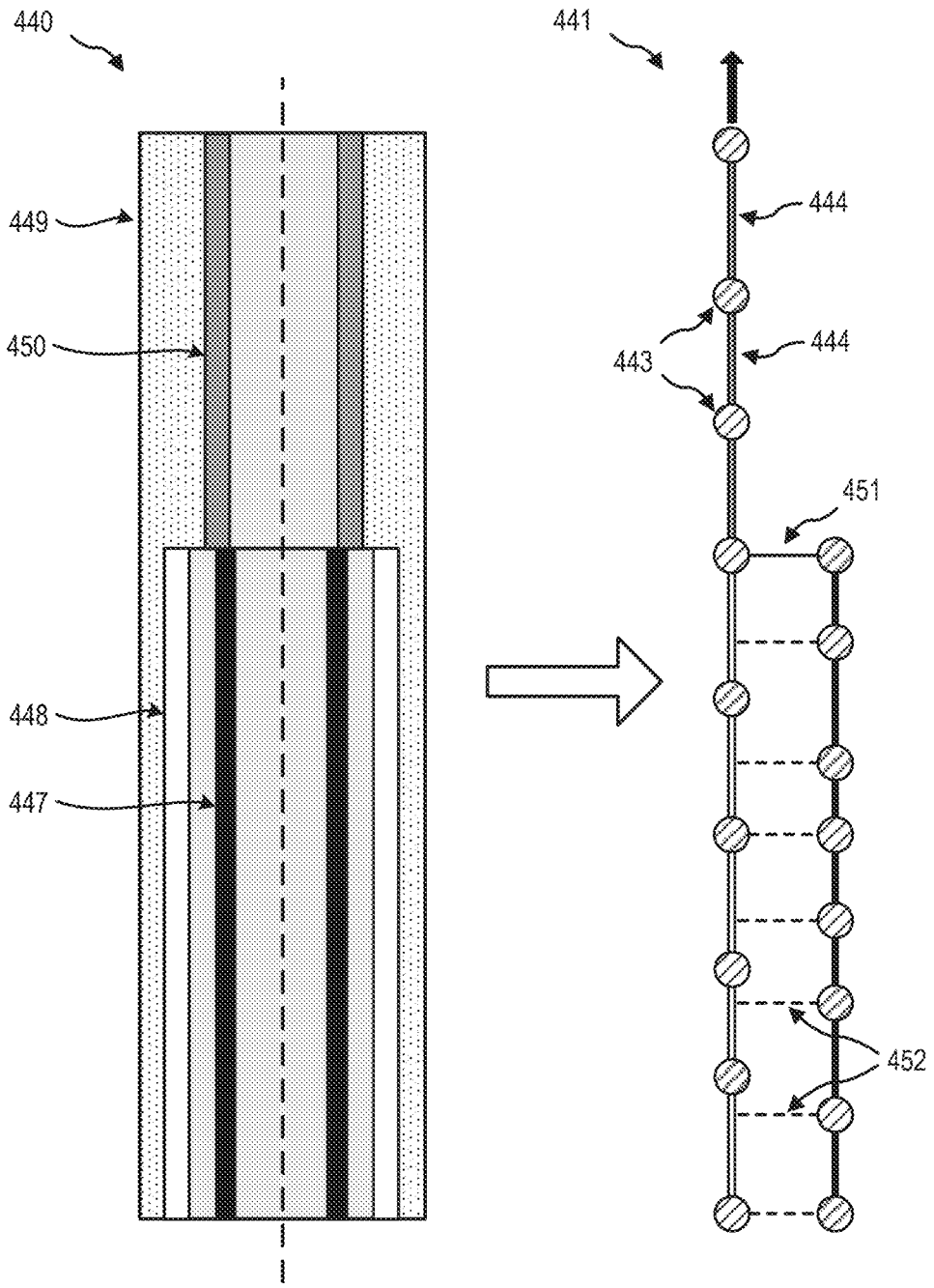

In some instances, drill strings may be implemented downhole that have multiple drill string layers at one or more locations. FIGS. 4-1 and 4-2 are schematic illustrations of an example drill string 440 having an inner string 447 and an outer, liner string 448. The drill string 440 may be implemented in a wellbore 449. The liner string 448 may be a casing for cementing to the wellbore 449 and the inner string 447 may extend within the liner string 448 for facilitating implementation or installation of the liner string 448. Many other situations may implement a drill string having one or more interior or inner sections (e.g., inner downhole tools) that may be applicable to the techniques described herein. For example, a downhole system may implement a BHA or other downhole tools in connection with an inner string for forming a wellbore at or below an outer, liner string. Indeed, while the techniques of the present disclosure may be primarily described herein with respect to a casing or liner string for installing and/or cementing a casing to the wellbore, it should be understood that the present techniques may be implemented with respect to any drill string or drilling tool assembly exhibiting two, nested layers. For example, the T&D analysis described herein may be applicable to completion components or complex completion strings having inner and outer layers. As another example, the dual layer techniques described herein may be applicable to dual string drilling which may implement nested or concentric drilling strings for various purposes. In this way, the T&D system described herein may facilitate analyzing any downhole system exhibiting multi-layer components at one or more locations.

As shown in FIG. 4-1, when the drill string 440 is implemented in a straight and/or vertical section of the wellbore 449, the inner string 447 may be positioned within the liner string 448 such that they do not contact. In some embodiments, the inner string 447 is coincident or coaxial with the liner string 448. In this way, no resultant contact forces may be exhibited between the inner string and the liner string 448. Similarly, in vertical sections of the wellbore 449, the liner string 448 may not contact the wellbore 449 (e.g., a wellbore wall of the wellbore 449) such that no resultant contact forces are exhibited between the liner string 448 and the wellbore 449. However, as shown in FIG. 4-2, in a curved or doglegged section of the wellbore 449, the drill string 440 may be bent or deformed around the curvature of the wellbore 449 and may contact the wellbore 449. Due to its multi-layer nature, the resulting behavior of the drill string 440 may be defined by a relationship of contact forces 446 between the inner string 447 and the liner string 448, as well as between the liner string 448 and the wellbore 449 (and/or other resultant inter-string dynamics). The interaction between the inner string 447 and the liner string 448, including the contact forces 446, may be complex. For example, when the inner string 447 contacts the inside of the liner string 448 (as shown in FIG. 4-2), it may influence the localized friction and resistance of the liner string 448 with respect to the wellbore 449. However, while the inner string 447 may be connected or fixed to the liner string 448 at one or more locations (e.g., an uphole end of the inner string 447), the inner string 447 may be somewhat free to move, deform, stretch, compress, etc., within the liner string 448. Similarly, the liner string 448 may be somewhat free to move, deform, stretch, compress, etc. with respect to the inner string 447. The contact points between these two layers may accordingly be difficult to predict and characterize accurately. For example, the behavior of the drill string 440 and the relationship between the inner string 447 and the liner string 448 may be functions of the properties, geometry, forces, etc. of the inner string 447 and the liner string 448 each independently, as well as functions of the interaction between the two. Thus, the T&D analysis for a multi-layer drill string greatly increases the complexity and difficulty over that of a single layer drill string.

For example, FIG. 4-3 illustrates a conventional technique for T&D analysis of the multi-layer drill string 440. As shown, the drill string 440 may include a landing string 450 from which the liner string 448 and inner string 447 are suspended. An FEA model 441 may be generated for the drill string 440. For example, a mesh may be generated and may define a series of finite elements 444 joined at nodes 443. A mesh for each of the landing string 450, liner string 448 and inner string 447 may be generated, and these meshes may be coupled or linked together based on the interaction between each of these portions of the drill string 440. For example, the mesh for the liner string 448 may be connected (e.g., rigidly) to the mesh for the landing string 450, representing the rigid connection between the liner string 448 and landing string 450. Similarly, the inner string 447 may be connected and/or associated (e.g., rigidly) with the landing string 450 via a rigid link 451. However, as mentioned above, other than this rigid connection of both the liner string 448 and the inner string 447 with the landing string 450 (and therefore with each other), these two layers may otherwise be substantially independent and may move, deform, stretch, etc., with respect to one another. However, also as mentioned above, there may be some interaction between the inner string 447 and the liner string 448 based on bends in the wellbore 449 causing contact between these nested string layers and between the wellbore 449. Thus, in order to accurately represent the resultant dynamics, and to perform an adequate T&D analysis, these interactions (e.g., contact between the inner string 447 and liner string 448) must be represented in the FEA model 441, which may conventionally be represented by a series of contact elements 452.

The interaction between the inner string 447 and the liner string 448 with respect to the wellbore 449 presents a highly complex phenomenon which may be very difficult to accurately represent with FEA techniques. For example, defining the shape functions for determining and representing the inter-layer interaction (e.g., the contact elements 452) may be highly complicated. Indeed, FEA modeling the multi-layer system may involve a high level of non-linearity and may result in significant convergence issues.

For example, the different layers may include different materials, dimensions, shapes, etc., resulting in distinct mechanical properties. The layers may accordingly have distinct elasticity, yield strength, failure modes, etc., which may require advances constitutive models to accurately account for. Further, properties of the layers may be non-uniform and modelling these non-uniformities accurately may require more sophisticated meshing and boundary conditions strategies over that of a single-layer approach. As another example, the FEA model 441 may have to account for friction and/or potential slippage between the two layers which may be computationally difficult. In another example, the different layers may exhibit different modes and/or severity of deformation, including buckling and helical behavior, making modeling the inter-layer interaction more complex. In another example, the nature of the downhole system itself may often involve large deformations, which may challenge traditional FEA techniques and required nonlinear analysis to accurately characterize the large deformations and material nonlinearity. Accounting for multiple, nested layers may result in even more nonlinearity. Finally, in downhole scenarios, boundary conditions may be difficult to define, and the interaction between the two layers and the surrounding geological formations may further complicate the analysis.

Further, even where the FEA model 441 may be accurately constructed and shape functions sufficiently defined, solving such a system may be computationally demanding, even prohibitively so. For example, high-performance computing resources and advances with software tools may be required to even solve these complex systems and equations, and even still, the results may not be accurate due to the many variables involve, leading to performance, accuracy, and reliability issues. Thus, modeling and solving a complete, multi-layer FEA model may not be an adequate solution for performing T&D analysis. The techniques of the present disclosure, however, provide benefits over these conventional techniques by performing multiple rounds or processes of single-layer FEA modeling in order to perform an accurate T&D analysis of multi-layer drill strings. The T&D system 120 described herein may utilize the (e.g., conventional) FEA techniques described herein (or any other known FEA techniques) but may do so in a novel way by implementing a unique, virtual wellbore which may enable the T&D system 120 to adequately handle multi-layer drill string problems where conventional techniques fall short.

Figure 5:
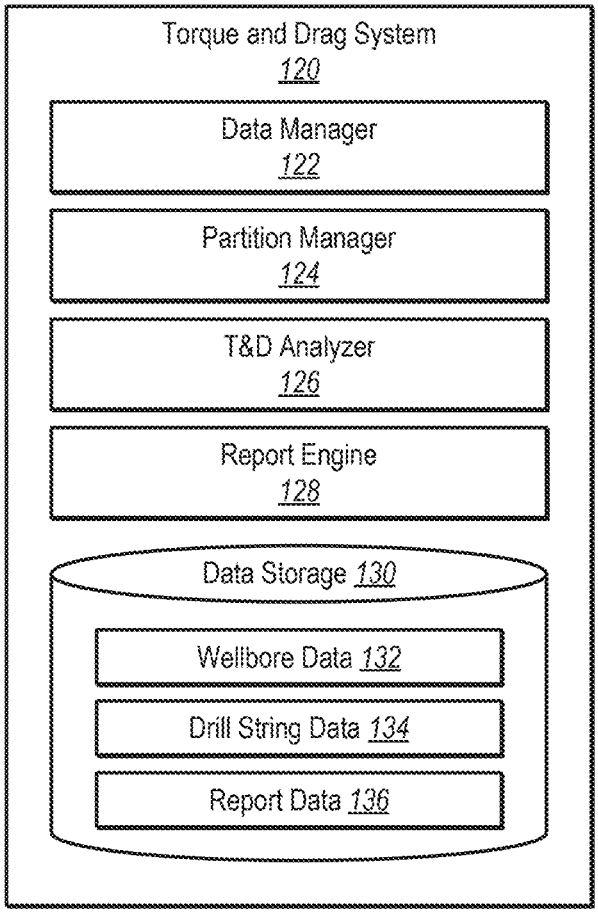
FIG. 5 illustrates an example implementation of a torque and drag system as described herein, according to at least one embodiment of the present disclosure.

FIG. 5 illustrates an example implementation of the T&D system 120 as described herein, according to at least one embodiment of the present disclosure. The T&D system 120 includes a data manager 122, a partition manager 124, a torque and drag (T&D) analyzer 126, and a report engine 128. The T&D system 120 also includes a data storage 130 having wellbore data 132, drill string data 134, and report data 136 stored thereon. While one or more embodiments described herein describe features and functionalities performed by specific components 122-128 of the T&D system 120, it will be appreciated that specific features described in connection with one component of the T&D system 120 may, in some examples, be performed by one or more of the other components of the T&D system 120.

By way of example, one or more of the data receiving, gathering, or storing features of the data manager 122 may be delegated to other components of the T&D system 120. As another example, while the drill string may be partitioned and a virtual wellbore generated by a partition manager 124, in some instances, some or all of these features may be performed by the T&D analyzer 126 (or another component of the T&D system 120). Indeed, it will be appreciated that some or all of the specific components may be combined into other components and specific functions may be performed by one or across multiple components 122-128 of the T&D system 120.

Additionally, while FIG. 1, for example, depicts the T&D system 120 implemented on a client device 112 of the downhole system, it should be understood that some or all of the features and functionalities of the T&D system 120 may be implemented on or across multiple client devices 112 and/or server devices 114. For example, data may be input and/or received by the data manager 122 on a (e.g., local) client device, and the torque and drag may be determined by the T&D analyzer on one or more of a remote, server, or cloud device. Indeed, it will be appreciated that some or all of the specific components 122-128 may be implemented on or across multiple client devices 112 and/or server devices 114, including individual functions of a specific component being performed across multiple devices.

As mentioned above, the T&D system 120 includes a data manager 122. The data manager 122 may receive a variety of types of data associated with the downhole system and may store the data to the data storage 130. The data manager 122 may receive the data from a variety of sources, such as from sensors, surveying tools, downhole tools, other (e.g., client) devices, user input, etc.

In some embodiments, the data manager 122 receives wellbore data 132 for a subject wellbore or a wellbore of interest. For example, the wellbore data 132 may be associated with a wellbore of an active operation of a downhole system (e.g., being actively drilled). In another example the wellbore data 132 may be associated with a wellbore that is being planned, studied, analyzed, or otherwise simulated to determine associated torque(s) and/or drag(s) for the wellbore. In this way, the T&D system 120 may be incorporated with any potential or existing wellbore of interest.

The wellbore data 132 may identify one or more aspects of the wellbore. For example, the wellbore data 132 may identify a trajectory (e.g., planned or actual) of the wellbore throughout one or more (or all) measurement depths. The trajectory may exhibit one or more bends, doglegs and/or curves throughout the length of the wellbore. Indeed, in many cases, wellbores may have trajectories that are highly deviated and exhibit a significant amount of curvature and/or tortuosity. The wellbore data 132 may accurately detail the geometry of the trajectory in order to facilitate the present techniques.

In some embodiments, the wellbore data 132 includes information related to the earth, rock, ground, or formation through which the wellbore traverses. For example, the wellbore data 132 may include geological data, geophysical data, and/or lithology data for the formation(s). The wellbore data 132 may include details related to a rock composition, structure, type, porosity, permeability, pressure, temperature, presence of hydrocarbons or other fluid, or any other property. The wellbore data 132 in this way may facilitate characterizing an interaction between a drill string and the formation, for example, to facilitate determining resultant contact forces and/or frictional forces between the drill string and the formation as described herein. In some embodiments, the wellbore data 132 identifies a coefficient of friction associated with various formations and/or subsurface features in relation to different downhole tools and/or drill strings that may come in to contact with the formations. In this way, the data manager 122 may receive wellbore data 132 that may facilitate characterizing the wellbore. The wellbore data 132 may include any other data associated with and/or relevant to the wellbore, pursuant to the techniques described herein. The data manager 122 may store the wellbore data 132 to the data storage 130.

In some embodiments, the data manager 122 receives drill string data 134 for a drill string of interest. For example, the drill string data 134 may be associated with a drill string being actively implemented downhole in an associated wellbore. In another example, the drill string data 134 may be associated with a plan, analysis, or simulation of a drill string to be implemented in a wellbore (e.g., existing or planned wellbore). The drill string data 134 may identify and/or may include information related to one or more downhole tools for implementing downhole and/or including in a drill string. For example, the drill string data 134 may include information related to a BHA, bit, reamer, motor, RSS, stabilizer, collar, tool joint, or any other downhole tool or component connected to or implemented in a drill string. The drill string data 134 may include information related to one or more lengths or sections of the drill string, such as one or more lengths of drill pipe, casing or liner, landing strings, running strings, inner strings, or any other portion or component of a drill string.

The drill string data 134 may identify information about the drill string, such as a geometric configuration and material properties of the drill string and/or drilling tools. For example, the drill string data 134 may identify dimensions of individual drill string components such as the length and diameter of each component. The drill string data 134 may identify a weight, composition, and makeup of drill string components, as well as a specification of tool joints and other connection features. The drill string data 134 may identify dynamic conditions during a downhole operation (e.g., real-time and/or simulated operation), such as weight-on-bit (WOB), rotary speed, drilling fluid properties, surface and/or downhole torque, hook load, or any other dynamics associated with the drill string. The data manager 122 may receive the drill string data 134 through one or more sensors, tools, measurement devices, client devices, or user input. The drill string data 134 may be received by the data manager 122 in real time, for example, during an active downhole operation. The data manager 122 may receive the drill string data 134 as part of a planning or simulation for implementing a drill string in a wellbore. In this way, the data manager 122 may receive the drill string data 134 in order to facilitate characterizing one or more aspects of the drill string. The data manager may store the drill string data 134 to the data manager 122.

In some embodiments, the data manager 122 receives user input. The data manager 122 may receive the user input, for example, via any of the client devices 112 and/or server devices 114. Any of the data described herein may be input or augmented via the user input. For example, in some instances, some or all of the wellbore data 132 is received by the data manager 122 as user input. The user input may be received in association with one or more functions or features of the T&D system 120.

Figures 1, 6:
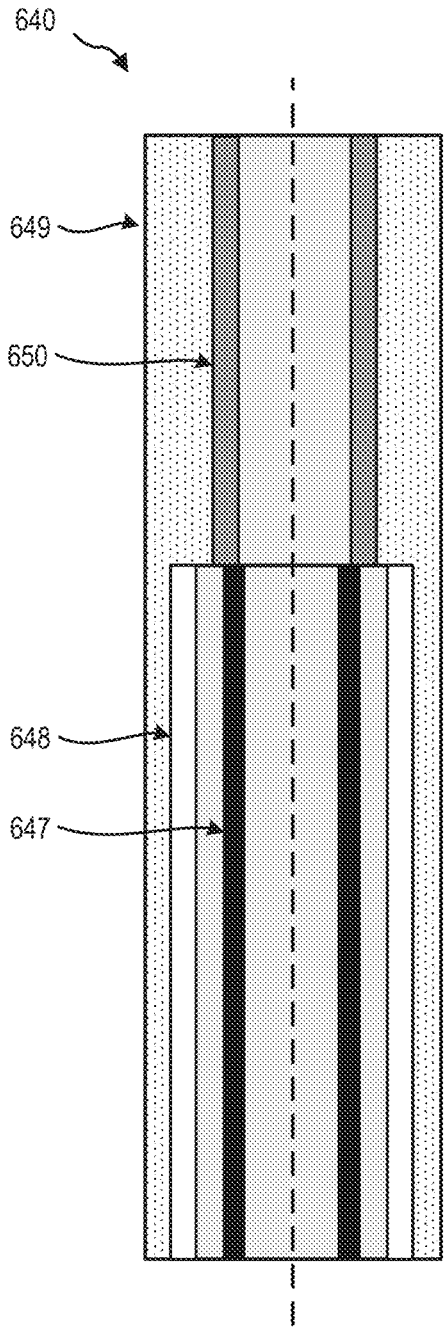
Figures 2, 6:
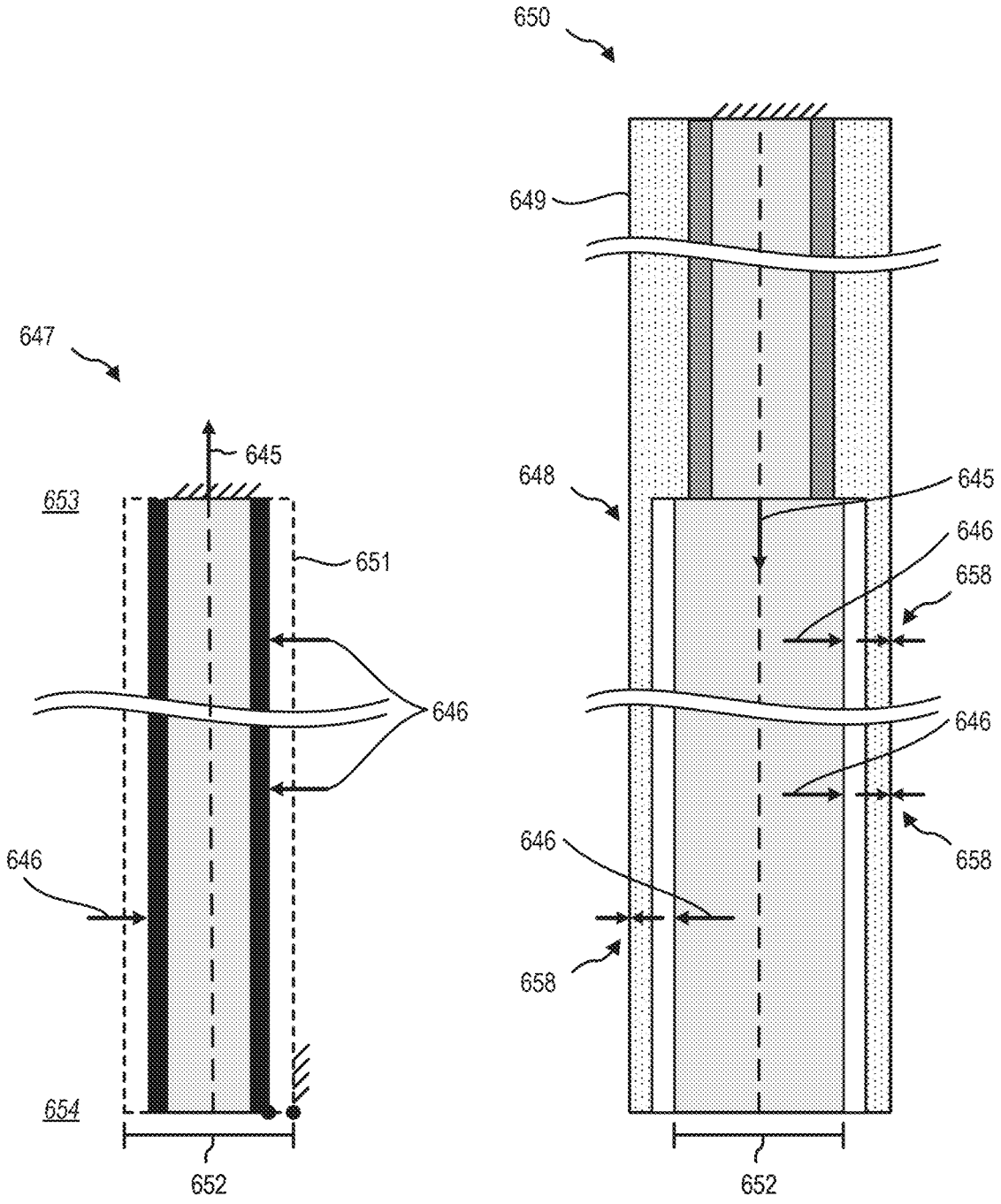
Figures 3, 6:
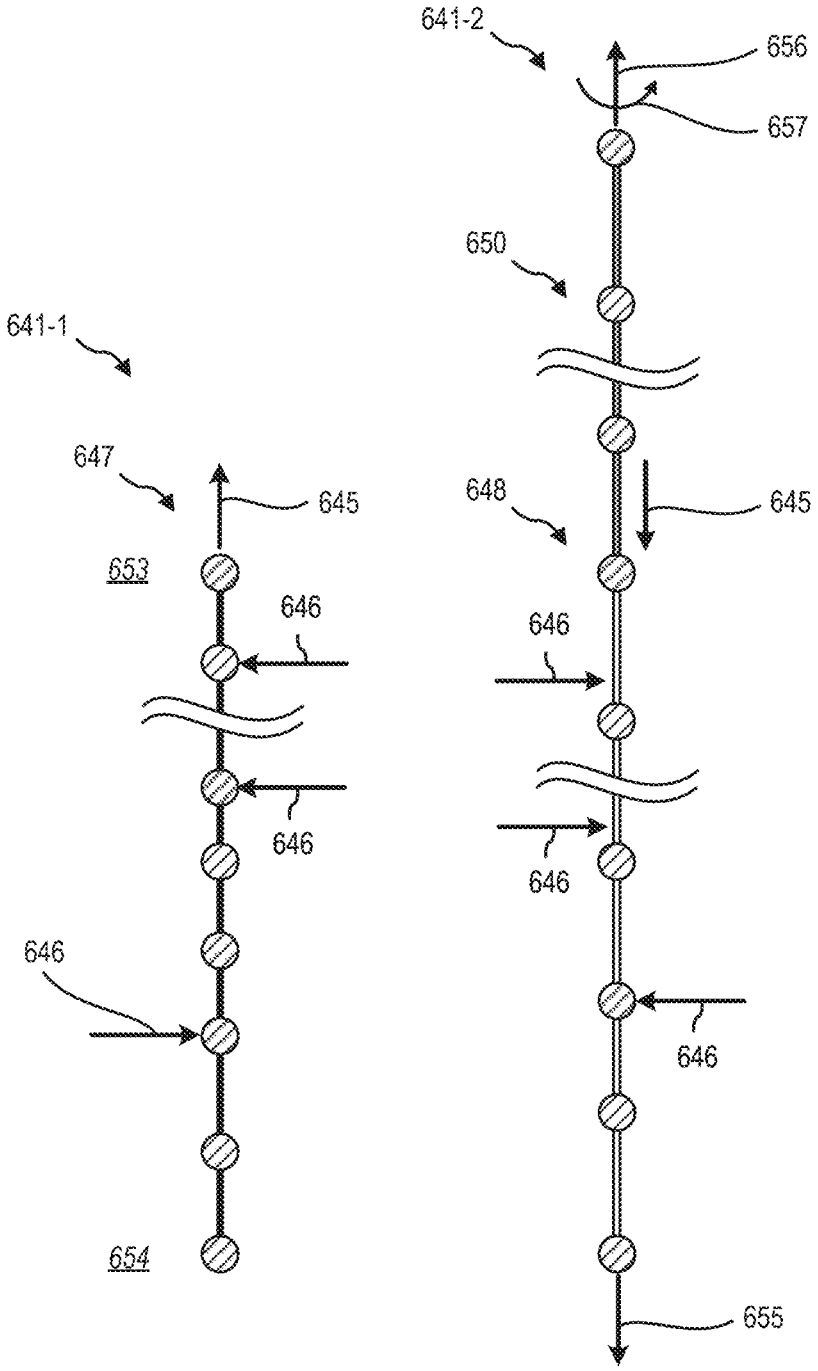

A mentioned above, the T&D system 120 includes a partition manager 124. The partition manager 124 may facilitate partitioning, decoupling, or otherwise separating the layers or portions of a drill string in order that they may be analyzed in isolation. FIGS. 6-1 through 6-3 are schematic representations illustrating an example partitioning of a drill string 640. As shown in FIG. 6-1, the drill string 640 may be implemented (or planned to be implemented) in a wellbore 649. The drill string 640 may include a landing string 650 coupled to a liner string 648 and inner string 647. The inner string 647 may be positioned within the liner string 648.

As discussed above, accurately modeling and solving a complete system representing both the liner string 648 and the inner string 647, including their interaction, may be highly complex and computationally demanding. In some embodiments, the partition manager 124 separates the inner string 647 from the liner string 648, as shown in FIG. 6-2. The partition manager 124 may separate these layers by simulating a set of constraints and/or boundary conditions for the inner string 647 such that it may be analyzed in isolation from the liner string 648. For example, the partition manager may define or generate a virtual wellbore 651. Generation of the virtual wellbore 651 may be based on the liner string 648. For example, the virtual wellbore 651 may be a simulation or approximation of a wellbore that may take the shape and/or form of the inner string 647. The geometry of the virtual wellbore 651 may be based on the geometry of the liner string 648. For example, one or more dimensions of the virtual wellbore 651, such as an inner diameter 652, may be that of the liner string 648. The virtual wellbore 651 may have a trajectory, path, orientation, curvature, and/or dogleg based on the liner string 648. For example, the trajectory/path of the virtual wellbore 651 may be the trajectory/path of the liner string 648. In another example, the trajectory/path of the virtual wellbore 651 may be the trajectory/path of the wellbore 649 (e.g., the virtual wellbore 651 may be the wellbore 649, but with the inner diameter 652 of the liner string 648). The virtual wellbore 651 may be constrained and/or determined such that it is fixed, rigid and/or does not move or deviate from the (e.g., curved) trajectory. In other words, for this portion of the analysis, the interaction of the inner string 647 with the liner string 648 (e.g., virtual wellbore 651) is assumed to have no effect on further deforming the liner string 648 based on the constraining the virtual wellbore 651 as rigid. In this way, the virtual wellbore 651 may simulate or approximate the liner string 648 as a wellbore in which the inner string 647 is situated.

In some embodiments, the association of the inner string 647 to the liner string 648 is approximated based on one or more constraints of the inner string 647 with respect to the virtual wellbore 651. For example, the inner string 647 may be grounded, fixed, coupled, or otherwise constrained to the virtual wellbore 651 at an upper or uphole end 653 of the inner string 647. The inner string 647 may be constrained in this way such that, when modelling, the inner string may not be permitted to move laterally, axially, and/or rotationally with respect to the virtual wellbore 651 at the uphole end 653. This may simulate the connection of the inner string 647 with the landing string 650. For example, in operation, the inner string 647 may not rotate with respect to the landing string 650 or the liner string 648 (e.g., they may all rotate together) and the inner string 647 may be accordingly constrained to not rotate with respect to the virtual wellbore 651. In this way, the connection of the inner string 647 to the liner string 648 and the landing string 650 at the uphole end 653 may be simulated.

In some embodiments, the inner string 647 is grounded, fixed, coupled, or otherwise constrained to the virtual wellbore 651 at a lower or downhole end 654 of the inner string 647. In some embodiments, the inner string 647 is constrained at the downhole end 654 such that it may not be permitted to move laterally, axially, and/or rotationally with respect to the virtual wellbore 651, similar to the constraint at the uphole end 653. In some embodiments, the inner string 647 is only constrained laterally at the downhole end 654, such that the inner string 647 may be permitted to move, stretch, compress, etc. axially and/or rotationally at the downhole end 654. This lower constraint may simulate a running tool, stabilizer, collar, etc. that may center or fix the inner string 647 (e.g., laterally) with respect to the liner string 648, or it may be a simplification or assumption for the purposes of modeling.

Based on the virtual wellbore 651, the partition manager 124 may determine one or more inner forces acting on and/or associated with the inner string 647. For example, the partition manager may determine an inner axial force 645. The inner axial force 645 may be based on a weight or hook load of the inner string 647. The inner axial force 645 may act on or may be associated with the uphole end 653 of the inner string 647. In this way, the inner axial force may simulate the force experienced by the inner string 647 at or by the connection or coupling of the inner string 647 with the liner string 648 and the landing string 650.

In some embodiments, the partition manager 124 determines one or more inner contact forces 646. For example, based on the virtual wellbore 651 (e.g., as a boundary condition), and more specifically based on the geometry or trajectory of the virtual wellbore 651, the partition manager 124 may determine one or more locations where the inner string 647 may contact the virtual wellbore 651. The partition manager 124 may accordingly determine inner contact forces 646 at these contact locations. The partition manager 124 may determine the inner contact forces 646 through the FEA analysis techniques described herein. For example, the partition manager 124 may represent the inner string 647 through a mesh of various nodes using the virtual wellbore as a boundary condition. The partition manager 124 may define and/or solve shape functions in order to represent the displacement of nodes within the mesh and infer the resulting inner contact forces 646. The partition manager 124 may determine a magnitude of the inner contact forces 646 based on the virtual wellbore 651, inner string tension, etc. In this way, the inner contact forces 646 between the inner string 647 and the virtual wellbore 651 may be generated to simulate the inter-layer interaction between the inner string 647 and the liner string 648. The partition manager 124 may determine any other force, torque, or other dynamic associated with the inner string 647 as part of the inner forces. For example, the partition manager 124 may determine a frictional force at the contact between the inner string 647 and liner string 648. In some cases, the partition manager 124 may ignore, negate, or otherwise treat friction as negligible between the inner string 647 and liner string 648. The partition manager 124 may store the inner forces to the data storage 130 as drill string data 134 to facilitate applying the inner forces with respect to the liner string 648 as discussed herein.

As shown in FIG. 6-3, an FEA model 641-1 may be generated for the inner string 647 in isolation as discussed above. The FEA model 641-1 may be generated based on the boundary conditions, constrains, and virtual wellbore 651 discussed above. For example, the finite elements, nodes, shape functions, etc., may be defined and analyzed based on the simulated conditions of the inner string 647 with respect to the virtual wellbore 651. In this way, the inner string 647 may be analyzed independent of the liner string 648 and the landing string 650 based on the FEA model 641-1. The FEA model 641-1 may be generated and/or solved by the partition manager 124 and/or the T&D analyzer 126 described in more detail below. The FEA model 641-1 may be a simpler model to solve, for example in contrast to the complex multi-layer approach discussed above, due to the FEA model 641-1 including the single layer inner string 647 simulated inside of the virtual wellbore 651.

Similar to separating the inner string 647 from the liner string 648, the partition manager 124 may facilitate analyzing the liner string 648 in isolation. For example, as shown in FIG. 6-2, the partition manager 124 may simulate the liner string 648 without the inner string 647. The partition manager 124 may simulate the liner string 648 implemented within the wellbore 649 and connected to the landing string 650, if applicable (e.g., in some instances, no landing string may be implemented such as if the liner string 648, or other equivalent outer string component, extends from the surface).

In some embodiments, the partition manager 124 incorporates one or more constraints or boundary conditions. For example, the landing string 650 (or liner string 648) may be grounded, fixed, or otherwise constrained to a top of the wellbore 649 or to the surface. The constraint may be such that, when modelling, the landing string 650 and/or the liner string 648 may be fixed rotationally, fixed axially, or fixed laterally, and combinations thereof. This may simulate the connection of the liner string 648 and landing string 650 with the surface, such as a coupling to a drill rig or other surface component.

In some embodiments, the partition manager 124 incorporates one or more of the determined inner forces from the inner string 647 as applied forces to the liner string 648 and/or landing string 650. For example, as shown in FIG. 6-2, the partition manager 124 may apply the inner axial force 645 as a force (e.g., equal and opposite reaction force) to the modelling of the liner string 648 and/or landing string 650. This may simulate the downward force (e.g., weight) of the inner string 647 exerted at the connection of the liner string 648 and landing string 650. In another example, the partition manager may apply the inner contact forces 646 as reaction forces to the liner string 648 in order to simulate the contact points where the inner string 647 and liner string 648 interact. Any other forces, torques, or other dynamics determined with respect to the inner string 647 may be incorporated and applied to the liner string 648 and/or landing string 650.

As shown in FIG. 6-3, an FEA model 641-2 may be generated for the liner string 648 in isolation as discussed above. The FEA model 641-2 may be generated based on the boundary conditions, constrains, and/or simulations discussed above. For example, finite elements, nodes, shape functions, etc., may be defined and analyzed based on the simulated conditions of the liner string 648 with respect to the wellbore 649. In this way, the liner string 648 may be analyzed independent of the inner string 647 based on the FEA model 641-2. The FEA model 641-2 may incorporate the inner forces of the inner string 647 as applied forces to the liner string 648 and/or landing string 650, as shown. For example, the determined inner forces from the inner string 647 may be applied to one or more nodes and/or elements of the liner string 648. The FEA model 641-2 may incorporate other applied forces as well. For example, the FEA model 641-2 may incorporate forces associated with a downhole tool, such as a WOB 655. The WOB 655 may be an applied axial force to a downhole portion or end of the liner string 648. In another example, the FEA model 641-2 may incorporate a hookload 656 associated with a weight of the landing string 650 and/or liner string 648. The FEA model 641-2 may incorporate one or more torques, such as a surface torque 657 applied by a drill rig or other surface component. The FEA model 641-2 may incorporate any other force, torque, or other dynamic relevant to the T&D analysis of the drill string. In this way, the FEA model 641-2 may be a single-layer FEA model associated with the liner string 648 but may incorporate and/or apply dynamics from the FEA model 641-1 in order to characterize and account for the interaction between the inner string 647 and the liner string 648.

As mentioned above, the T&D system 120 includes a T&D analyzer 126. The T&D analyzer 126 may solve one or more of the FEA model 641-1 and/or the FEA model 641-2. For example, the T&D analyzer 126 may facilitate determining the inner force of the inner string 647 associated with the FEA model 641-1. In another example, the T&D analyzer 126 may solve the FEA model 641-2 in order to determine one or more dynamics associated with the liner string 648. The FEA model 641-1 (and the FEA model 641-2) may be implementations that may incorporate any of the FEA techniques described herein. For example, the FEA model 641-1 and the FEA model 641-2 may represent the inner string 647 and/or liner string 648 (independently as described herein) through a mesh of nodes with various boundary conditions, shape functions, element stiffness matrices, applied loads, etc., and the FEA models may be solved to determine resulting forces, stresses, strains, etc. acting on the inner string 647, liner string 648, and/or landing string 650. For example, the T&D analyzer 126 may determine, based on the FEA model 641-2 including the applied inner force, one or more normal forces 658 between the liner string 648 and the wellbore 649. The normal forces 658 may be forces associated with areas where the liner string 648 makes contact with the wellbore 649, such as through a curve or dogleg of the wellbore 649. Additionally, the T&D analyzer 126 may determine one or more normal forces 658 between the landing string 650 and the wellbore 649 where applicable. The normal forces 658 may be based on and/or influenced by the tension within the liner string 648 and/or landing string 650 pulling the liner string 648 against the wellbore 649. Additionally, the normal forces 658 may be affected by the inner string 647 contacting the liner string 648 and further pressing the liner string 648 against the wellbore 649. The normal forces 658 may result in frictional resistance by the wellbore 649 to the movement of the drill string, for example, as the drill string is rotated and/or tripped into or out of the wellbore 649. In this way the normal forces 658 may influence or affect the torque and drag experienced by the drill string. For example, frictional forces resultant from the normal forces 658 may increase the axial tension in one or more portions of the drill string as it is pulled out of, or advanced into the wellbore 649. In another example, the frictional forces may increase the torque experienced by the drill string as it is rotated within the wellbore 649. Thus, the normal forces 658 may be valuable metrics for determining T&D dynamics of the drill string, and the T&D analyzer 126 may facilitate determine the normal forces 658.

In this way, T&D analyzer 126 may determine T&D metrics and dynamics for the multi-layered drill string by solving and/or utilizing the single layer FEA model 641-2. For example, the T&D analyzer 126 may determine one or more of a torque, axial drag, tension, compression, contact, friction, buckling, helical deformation, downhole equipment behavior, or any other associated T&D measure at one or more locations of the drill string. Implementing the FEA model 641-1 and FEA model 641-2 each as separate, single-layer models is significant in that it allows conventional FEA techniques to be implemented to solve the complex problems of a multi-layered drill string by defining and incorporating the unique boundary conditions and constrains of the virtual wellbore and applying the relevant dynamics from the inner string 647 to the liner string 648. The T&D analyzer 126 may store any of the determined metrics or dynamics to the data storage 130 as drill string data 134.

Figure 7:
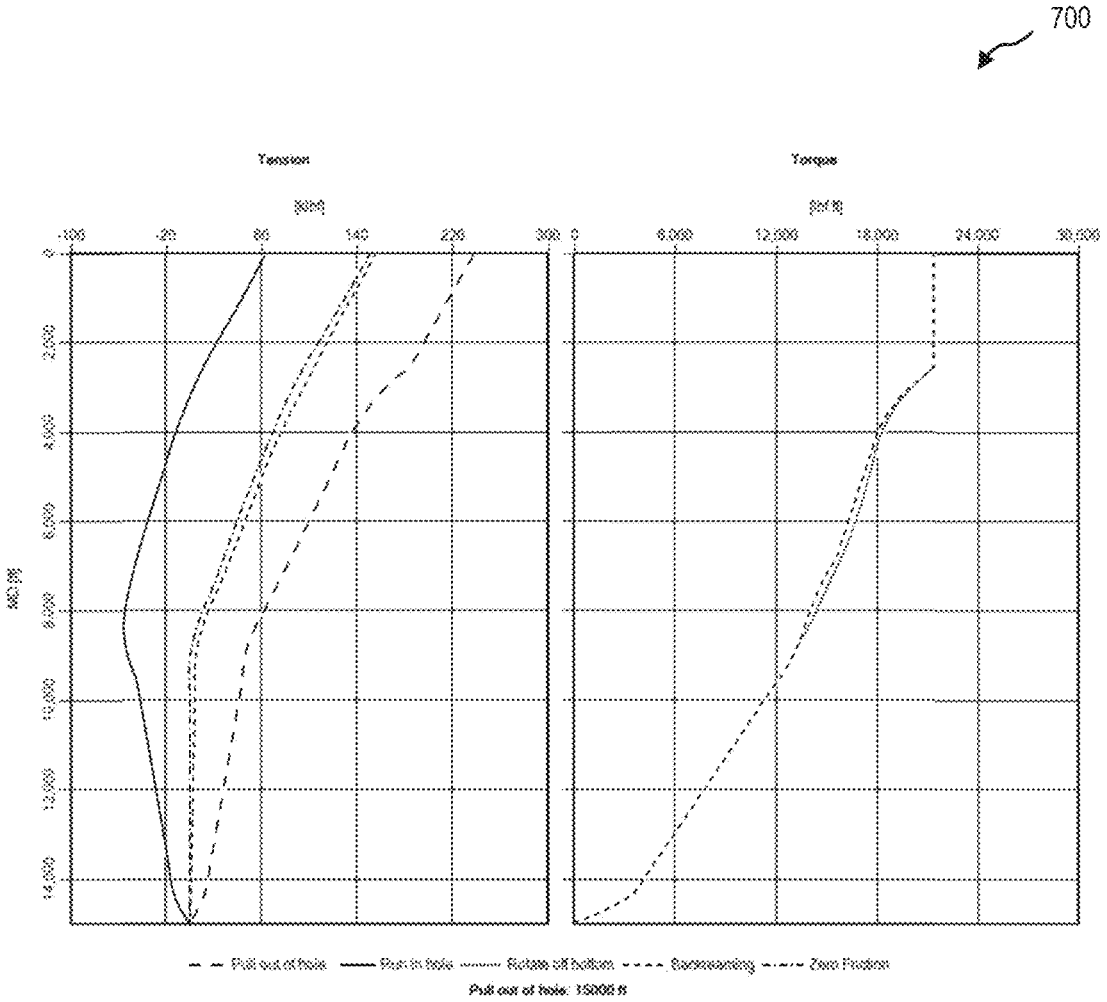
FIG. 7 illustrates an example report generated by a report engine, according to at least one embodiment of the present disclosure.

As mentioned above, the T&D system 120 includes a report engine 128. The report engine 128 may generate and/or present one or more reports associated with the T&D analysis described above. For example, FIG. 7 illustrates an example report 700 generated by the report engine 128. As shown, the report 700 may illustrate one or plots associated with one or more T&D dynamics, such as tension and torque. The report 700 may include and/or plot any other associated T&D dynamic. The report 700 may represent determined T&D dynamics for various downhole conditions, such as for different situations or operations of the downhole system. As shown, the report 700 may indicate a baseline torque and/or drag (e.g., zero friction) associated with the drill string being static in the wellbore. The report 700 may indicate a torque and/or drag associated with advancing the drill string into and/or tripping the drill string out of the wellbore. The report 700 may indicate a torque and/or drag associated with rotating the drill string in the wellbore, which may be in conjunction with pulling the drill string out of the wellbore. The report 700 may indicate a torque and/or drag associated with backreaming with a downhole tool as the drill string is being removed from the wellbore. The report 700 may indicated any other T&D dynamic determined by the T&D system 120 and may represent any dynamic with respect to any other relevant situation, condition, or operation of the downhole system. In some embodiments, the report engine 128 presents the report 700 via a graphical user interface of a user device. The report engine 128 may store the report 700 to the data storage 130 as report data 136.

Figures 1, 8:
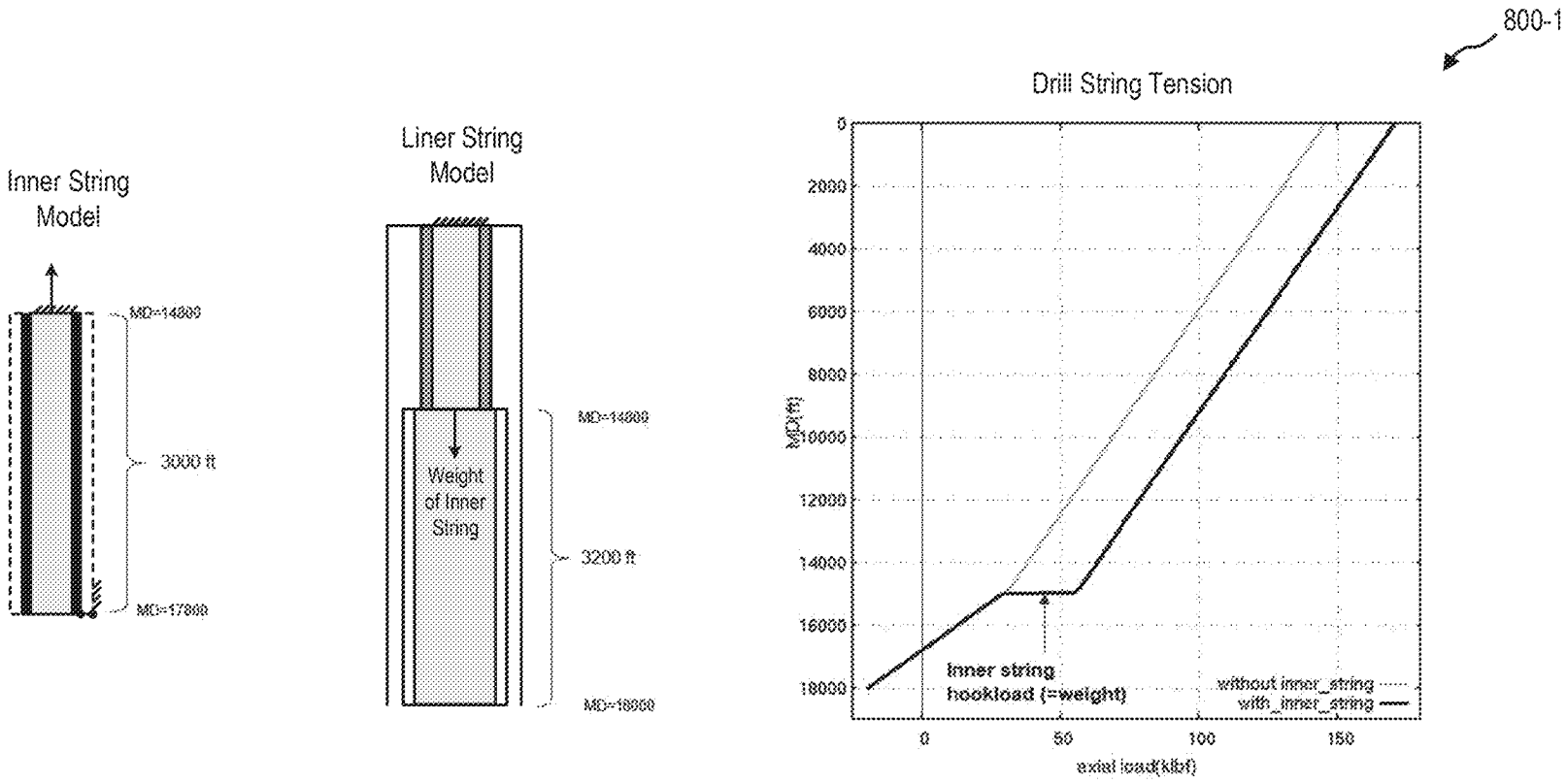
Figures 2, 8:
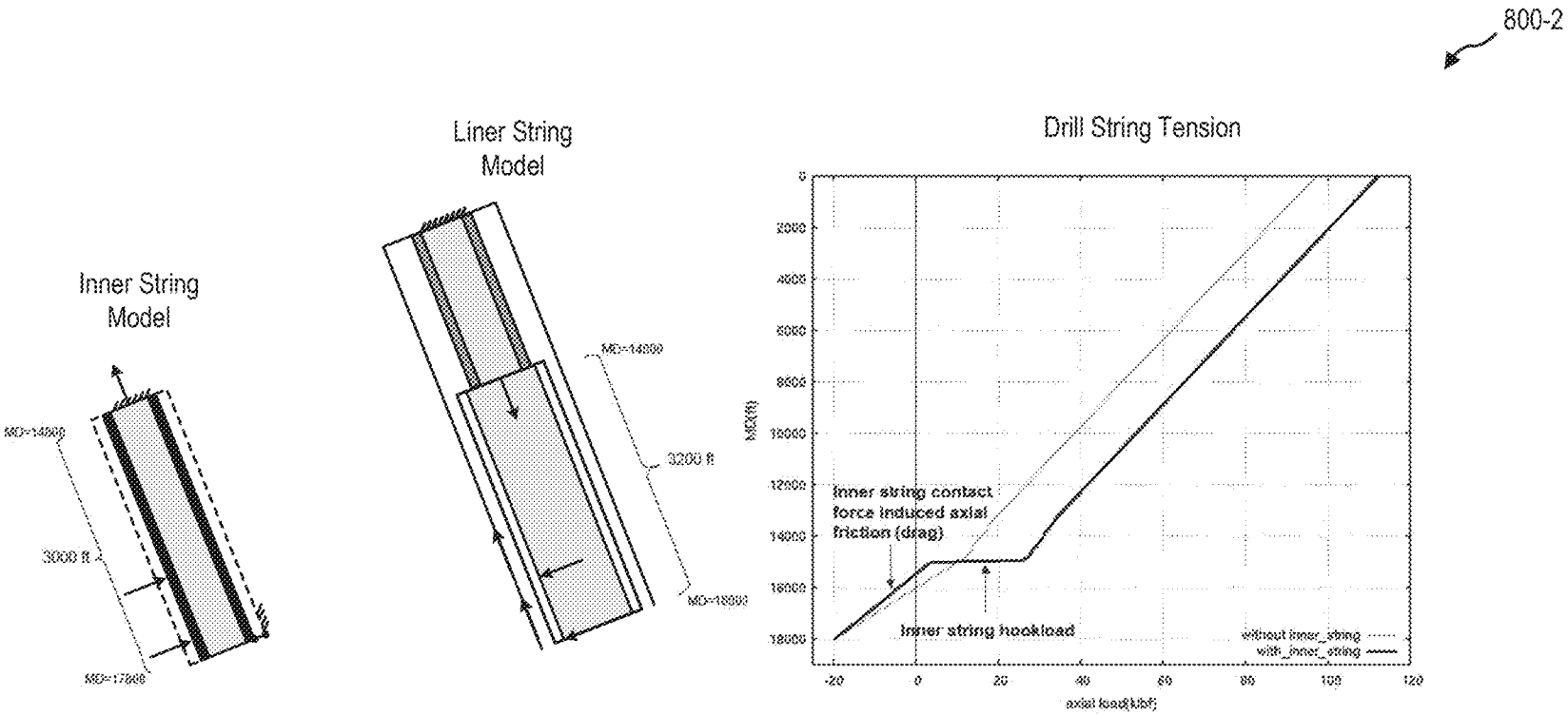

FIG. 8-1 illustrates an example report 800-1 for T&D analysis of a multi-layer drill string with respect to a vertical wellbore and FIG. 8-2 illustrates an example report 800-2 for T&D analysis of a multi-layer drill string with respect to a wellbore having an incline. The reports 800-1 and 800-2 may present and/or plot a tension of the drill string through a range of measurement depths. Additionally or alternatively, the reports 800-1 and 800-1 may be in relation to any other T&D dynamic, such as torque.

As shown, the reports 800-1 and 800-2 each present two different representations of tension in the drill string. The "without inner string" plot may be a representation of the determined tension throughout the drill string without accounting for the inner string, such as based on a simplified, single-layer model of just the liner string. The "with inner string" plot, however, may be based on the models illustrated in FIGS. 8-1 and 8-2 (respectively), and may represent the tension throughout the drill string taking into account the inner string and interaction between the inner string and liner string, as discussed herein. As shown in FIG. 8-1, the tension or hookload determined for the drill string may be the same in both cases at a point below where the inner string is coupled to the liner string and landing string. This may be due to the fact that the inner string and liner string hanging vertically may not interact in a completely vertical well. However, in the inner string plot, the tension may be offset at a point where the inner string is connected to the landing string. Indeed, the hookload observed at the surface may reflect this offset and may account for a difference of nearly 25 klbf when accounting for the inner string. In this way, they report 800-1 illustrates the increased accuracy and precision of the present modeling techniques.

This affect is further illustrated by the report 800-2 of FIG. 8-2. The report 800-2 may be associated with a simulation of a wellbore having an incline, such as 30 degrees. While the drill string tension for the vertical wellbore in the report 800-1 appears to be unaffected by the inner string below a point where the inner string is coupled to the landing string, as shown in the report 800-2, the interaction between the inner string and the liner string may, in an inclined wellbore, influence the drill string tension. For example, the inner contact forces between the inner string and the liner string may be observed, below 14,800 ft, to increase the frictional force exerted on the liner string by the wellbore, thereby reducing the tension in the drill string. This may be a simplified example to illustrate the advantages provided by the techniques described herein, and more highly deviated wells may benefit to a further extent from the increased accuracy and precision provided by the T&D system 120. The report engine 128 may store the report 800-1 and 800-2 to the data storage 130 as report data 136.

Figure 9:
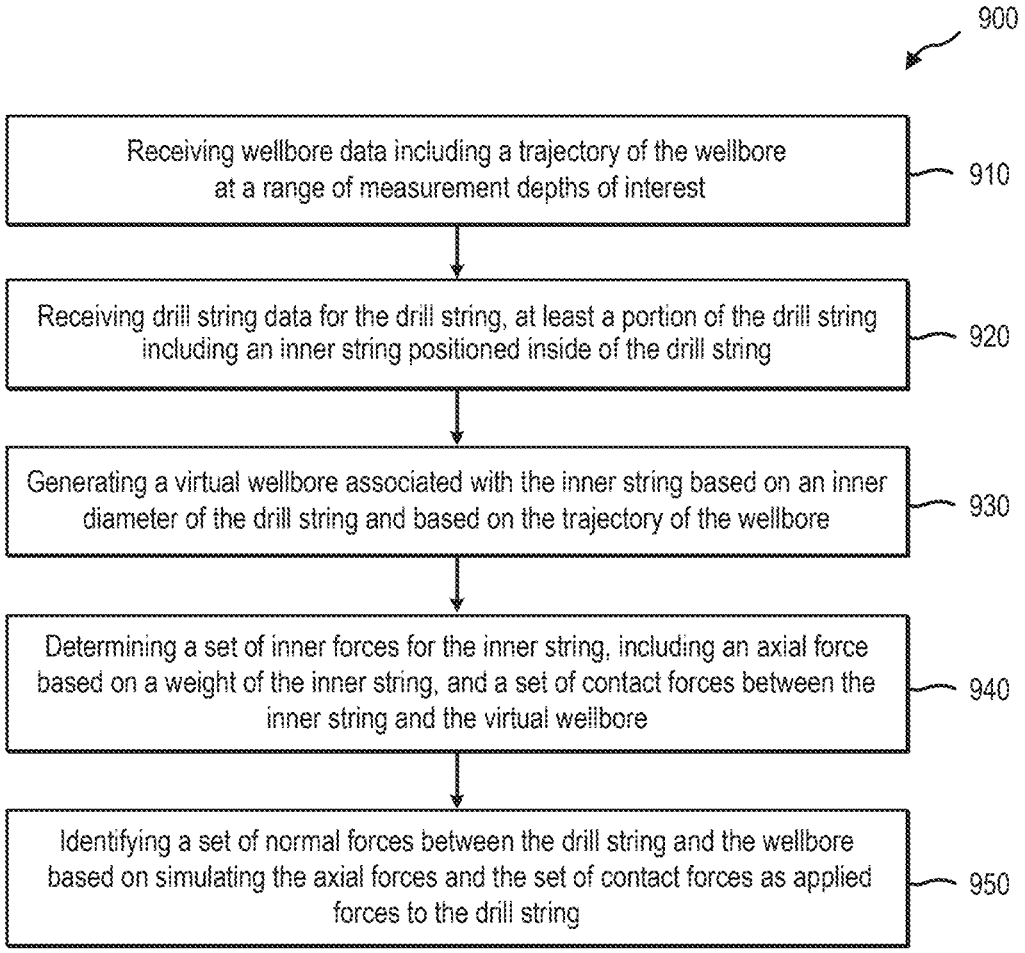
FIG. 9 illustrates a method or a series of acts for analyzing torque and drag of a drill string in a wellbore as described herein, according to at least one embodiment of the present disclosure.

FIG. 9 illustrates a method 900 or a series of acts for analyzing torque and drag of a drill string in a wellbore as described herein, according to at least one embodiment of the present disclosure. While FIG. 9 shows acts according to one embodiment, alternative embodiments may add to, omit, reorder, or modify any of the acts of FIG. 9.

In some embodiments, the method 900 includes an act 910 of receiving wellbore data including a trajectory of the wellbore at a range of measurement depths of interest.

In some embodiments, the method 900 includes an act 920 of receiving drill string data for the drill string, at least a portion of the drill string including an inner string positioned inside of the drill string. The drill string may include a liner string connected to a downhole end of a landing string. The inner string may be positioned inside of the liner string. The liner string may be a casing for cementing to the wellbore. The drill string data may identify properties of the drill string.

In some embodiments, the method 900 includes an act 930 of generating a virtual wellbore associated with the inner string based on an inner diameter of the drill string and based on the trajectory of the wellbore.

In some embodiments, the method 900 includes an act 940 of determining a set of inner forces for the inner string. For example, the inner forces may include an axial force based on a weight of the inner string and a set of contact forces between the inner string and the virtual wellbore. In some embodiments, the T&D system determines the set of inner forces based on simulating an axial load applied to the drill string to pull the drill string out of the wellbore or advance the drill string into the wellbore. The T&D system may determine the set of inner forces based on simulating a torque applied to the drill string to rotate the drill string within the wellbore. In some embodiments, the T&D system determines the set of inner forces based on constraining a downhole end of the inner string to be laterally fixed with respect to the virtual wellbore. The T&D system may determine the set of inner forces based on constraining an uphole end of the inner string to be axially, laterally, and rotationally fixed with respect to the virtual wellbore. The set of inner forces may be determined based on ignoring friction between the inner string and the drill string.

In some embodiments, the method 900 includes an act 950 of identifying a set of normal forces between the drill string and the wellbore based on simulating the axial forces and the set of contact forces as applied forces to the drill string. In some embodiments, the T&D system identifies the set of normal forces based on simulating an axial load applied to the drill string to pull the drill string out of the wellbore or advance the drill string into the wellbore. The T&D system may identify the set of normal forces based on simulating a torque applied to the drill string to rotate the drill string within the wellbore. In some embodiments, the set of normal forces between the drill string and the wellbore is identified independent of determining the set of inner forces of the inner string. For example, the set of inner forces may be determined based on a first single-layer finite element analysis (FEA) model and the set of normal forces may be identified based on a second single-layer FEA model.

In some embodiments, the T&D system determines one or more axial frictional forces acting on the drill string at one or more measurement depths based on the set of normal forces. The T&D system may also determine an axial tension of the drill string at one or more locations based on the axial frictional forces and may generate a plot of the axial tension of the drill string at one or more of the measurement depths of interest. In some embodiments, the T&D system determines one or more torsional frictional forces acting on the drill string at one or more measurement depths based on the set of normal forces. T&D system may also determine a torque of the drill string at one or more locations based on the torsional frictional forces and may generate a plot of the torque of the drill string at one or more of the measurement depths of interest.

Figure 10:
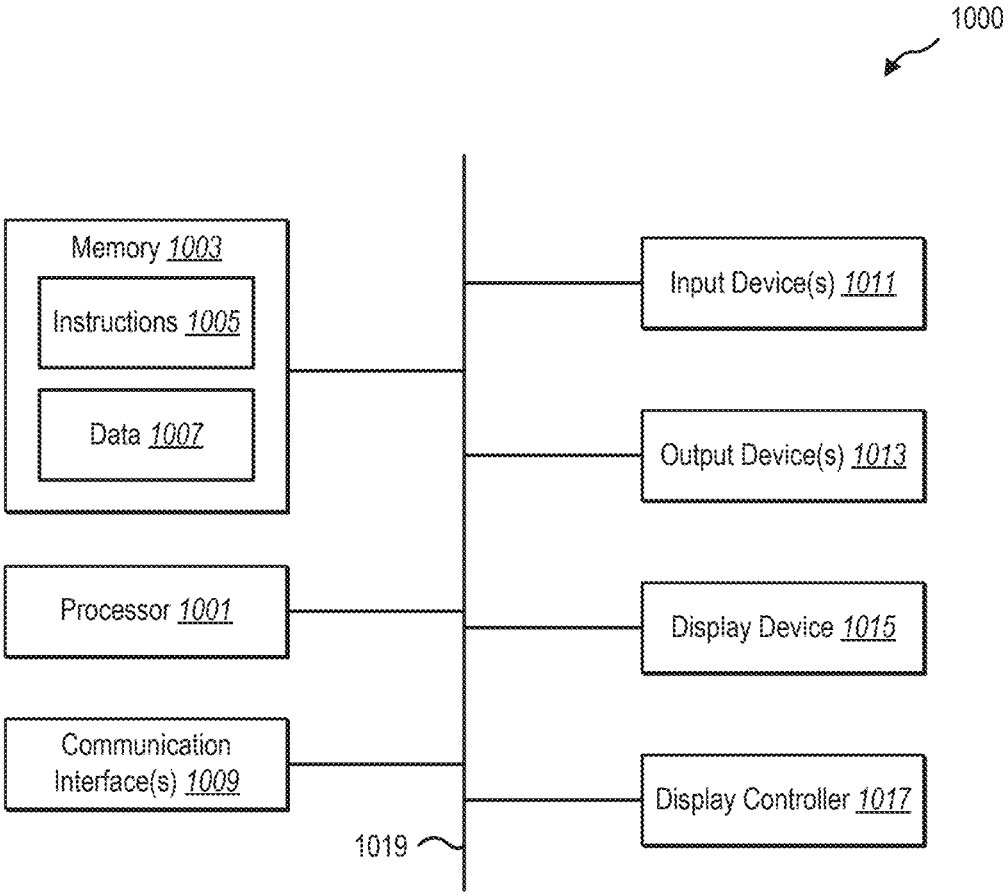
FIG. 10 illustrates certain components that may be included within a computer system.

Turning now to FIG. 10, this figure illustrates certain components that may be included within a computer system 1000. One or more computer systems 1000 may be used to implement the various devices, components, and systems described herein.

The computer system 1000 includes a processor 1001. The processor 1001 may be a general-purpose single- or multi-chip microprocessor (e.g., an Advanced RISC (Reduced Instruction Set Computer) Machine (ARM)), a special purpose microprocessor (e.g., a digital signal processor (DSP)), a microcontroller, a programmable gate array, etc. The processor 1001 may be referred to as a central processing unit (CPU). Although just a single processor 1001 is shown in the computer system 1000 of FIG. 10, in an alternative configuration, a combination of processors (e.g., an ARM and DSP) could be used.

The computer system 1000 also includes memory 1003 in electronic communication with the processor 1001. The memory 1003 may include computer-readable storage media and may be any available media that may be accessed by a general purpose or special purpose computer system. Computer-readable media that store computer-executable instructions are non-transitory computer-readable media (device). Computer-readable media that carry computer-executable instructions are transmission media. Thus, by way of example and not limitations, embodiment of the present disclosure may comprise at least two distinctly different kinds of computer-readable media: non-transitory computer-readable media (devices) and transmission media.

Both non-transitory computer-readable media (devices) and transmission media may be used temporarily to store or carry software instructions in the form of computer readable program code that allows performance of embodiments of the present disclosure. Non-transitory computer-readable media may further be used to persistently or permanently store such software instructions. Examples of non-transitory computer-readable storage media include physical memory (e.g., RAM, ROM, EPROM, EEPROM, etc.), optical disk storage (e.g., CD, DVD, HDDVD, Blu-ray, etc.), storage devices (e.g., magnetic disk storage, tape storage, diskette, etc.), flash or other solid-state storage or memory, or any other non-transmission medium which may be used to store program code in the form of computer-executable instructions or data structures and which may be accessed by a general purpose or special purpose computer, whether such program code is stored or in software, hardware, firmware, or combinations thereof.

Instructions 1005 and data 1007 may be stored in the memory 1003. The instructions 1005 may be executable by the processor 1001 to implement some or all of the functionality disclosed herein. Executing the instructions 1005 may involve the use of the data 1007 that is stored in the memory 1003. Any of the various examples of modules and components described herein may be implemented, partially or wholly, as instructions 1005 stored in memory 1003 and executed by the processor 1001. Any of the various examples of data described herein may be among the data 1007 that is stored in memory 1003 and used during execution of the instructions 1005 by the processor 1001.

A computer system 1000 may also include one or more communication interfaces 1009 for communicating with other electronic devices. The communication interface(s) 1009 may be based on wired communication technology, wireless communication technology, or both. Some examples of communication interfaces 1009 include a Universal Serial Bus (USB), an Ethernet adapter, a wireless adapter that operates in accordance with an Institute of Electrical and Electronics Engineers (IEEE) 802.11 wireless communication protocol, a Bluetooth® wireless communication adapter, and an infrared (IR) communication port.

The communication interfaces 1009 may connect the computer system 1000 to a network. A "network" or "communications network" may generally be defined as one or more data links that enable the transport of electronic data between computer systems and/or modules, engines, or other electronic devices, or combinations thereof. When information is transferred or provided over a communication network or another communications connection (either hardwired, wireless, or a combination of hardwired or wireless) to a computing device, the computing device properly views the connection as a transmission medium. Transmission media may include a communication network and/or data links, carrier waves, wireless signals, and the like, which may be used to carry desired program or template code means or instructions in the form of computer-executable instruction or data structures and which may be accessed by a general purpose or special purpose computer.

A computer system 1000 may also include one or more input devices 1011 and one or more output devices 1013. Some examples of input devices 1011 include a keyboard, mouse, microphone, remote control device, button, joystick, trackball, touchpad, and lightpen. Some examples of output devices 1013 include a speaker and a printer. One specific type of output device that is typically included in a computer system 1000 is a display device 1015. Display devices 1015 used with embodiments disclosed herein may utilize any suitable image projection technology, such as liquid crystal display (LCD), light-emitting diode (LED), gas plasma, electroluminescence, or the like. A display controller 1017 may also be provided, for converting data 1007 stored in the memory 1003 into one or more of text, graphics, or moving images (as appropriate) shown on the display device 1015.

The various components of the computer system 1000 may be coupled together by one or more buses, which may include one or more of a power bus, a control signal bus, a status signal bus, a data bus, other similar components, or combinations thereof. For the sake of clarity, the various buses are illustrated in FIG. 10 as a bus system 1019.

The techniques described herein may be implemented in hardware, software, firmware, or any combination thereof, unless specifically described as being implemented in a specific manner. Any features described as modules, components, or the like may also be implemented together in an integrated logic device or separately as discrete but interoperable logic devices. If implemented in software, the techniques may be realized at least in part by a non-transitory processor-readable storage medium comprising instructions that, when executed by at least one processor, perform one or more of the methods described herein. The instructions may be organized into routines, programs, objects, components, data structures, etc., which may perform particular tasks and/or implement particular data types, and which may be combined or distributed as desired in various embodiments.

Further, upon reaching various computer system components, program code in the form of computer-executable instructions or data structures may be transferred automatically or manually from transmission media to non-transitory computer-readable storage media (or vice versa). For example, computer executable instructions or data structures received over a network or data link may be buffered in memory (e.g., RAM) within a network interface module (NIC), and then eventually transferred to computer system RAM and/or to less volatile non-transitory computer-readable storage media at a computer system. Thus, it should be understood that non-transitory computer-readable storage media may be included in computer system components that also (or even primarily) utilize transmission media.

INDUSTRIAL APPLICABILITY

In some embodiments, a downhole system is implemented for drilling an earth formation to form a wellbore. The downhole system includes a drill rig used to turn a drilling tool assembly which extends downward into the wellbore. The drilling tool assembly may include a drill string, a bottomhole assembly ("BHA"), and a bit, attached to the downhole end of the drill string.

The drill string may include several joints of drill pipe connected end-to-end through tool joints. The drill string transmits drilling fluid through a central bore and transmits rotational power from the drill rig to the BHA. In some embodiments, the drill string further includes additional downhole drilling tools and/or components such as subs, pup joints, etc. The drill pipe provides a hydraulic passage through which drilling fluid is pumped from the surface. The drilling fluid discharges through selected-size nozzles, jets, or other orifices in the bit for the purposes of cooling the bit and cutting structures thereon, and for lifting cuttings out of the wellbore as it is being drilled.

The BHA may include the bit, other downhole drilling tools, or other components. An example BHA 106 may include additional or other downhole drilling tools or components (e.g., coupled between to the drill string and the bit). Examples of additional BHA components include drill collars, stabilizers, measurement-while-drilling ("MWD") tools, logging-while-drilling ("LWD") tools, downhole motors, underreamers, section mills, hydraulic disconnects, jars, vibration or dampening tools, other components, or combinations of the foregoing.

In general, the downhole system may include other downhole drilling tools, components, and accessories such as special valves (e.g., kelly cocks, blowout preventers, and safety valves). Additional components included in the downhole system 100 may be considered a part of the drilling tool assembly, the drill string, or a part of the BHA 106, depending on their locations in the downhole system.

The bit in the BHA may be any type of bit suitable for degrading downhole materials. For instance, the bit may be a drill bit suitable for drilling the earth formation. Example types of drill bits used for drilling earth formations are fixed-cutter or drag bits. In other embodiments, the bit may be a mill used for removing metal, composite, elastomer, other materials downhole, or combinations thereof. For instance, the bit may be used with a whipstock to mill into casing lining the wellbore. The bit may also be a junk mill used to mill away tools, plugs, cement, other materials within the wellbore, or combinations thereof. Swarf or other cuttings formed by use of a mill may be lifted to the surface or may be allowed to fall downhole. The bit may include one or more cutting elements for degrading the earth formation.

The BHA may further include a rotary steerable system (RSS). The RSS may include directional drilling tools that change a direction of the bit, and thereby the trajectory of the wellbore. At least a portion of the RSS may maintain a geostationary position relative to an absolute reference frame, such as one or more of gravity, magnetic north, or true north. Using measurements obtained with the geostationary position, the RSS may locate the bit, change the course of the bit, and direct the directional drilling tools on a projected trajectory. The RSS may steer the bit in accordance with or based on a trajectory for the bit. For example, a trajectory may be determined for directing the bit toward one or more subterranean targets such as an oil or gas reservoir.

The downhole system may include or may be associated with one or more client devices with a torque and drag (T&D) system implemented thereon (e.g., implemented on one, several, or across multiple client devices). The T&D system may facilitate calculating and/or assessing forces and/or other parameters that may act on the drill string in association with the drill string advancing into or being retrieved from the wellbore.

In some embodiments, a T&D system is implemented in an example environment in accordance with one or more embodiments describe herein. The environment includes one or more server device(s). The server device(s) may include one or more computing devices (e.g., including processing units, data storage, etc.) organized in an architecture with various network interfaces for connecting to and providing data management and distribution across one or more client systems. The server devices may be connected to and may communicate with (either directly or indirectly) one or more client devices through a network. The network may include one or multiple networks and may use one or more communication platforms and/or technologies suitable for transmitting data. The network may refer to any data link that enables transport of electronic data between devices of the environment. The network may refer to a hardwired network, a wireless network, or a combination of a hardwired network and a wireless network. In one or more embodiments, the network includes the internet. The network may be configured to facilitate communication between the various computing devices via well-site information transfer standard markup language (WITSML) or similar protocol, or any other protocol or form of communication.

The client device may refer to various types of computing devices. For example, one or more client devices may include a mobile device such as a mobile telephone, a smartphone, a personal digital assistant (PDA), a tablet, a laptop, or any other portable device. Additionally, or alternatively, the client devices may include one or more non-mobile devices such as a desktop computer, server device, surface or downhole processor or computer (e.g., associated with a sensor, system, or function of the downhole system), or other non-portable device. In one or more implementations, the client devices include graphical user interfaces (GUI) thereon (e.g., a screen of a mobile device). In addition, or as an alternative, one or more of the client devices may be communicatively coupled (e.g., wired or wirelessly) to a display device having a graphical user interface thereon for providing a display of system content. The server device(s) may similarly refer to various types of computing devices. Each of the devices of the environment may include features and/or functionalities described below.

The environment may include a T&D system implemented on one or more computing devices. The T&D system may be implemented on one or more client device, server devices, and combinations thereof. Additionally, or alternatively, the T&D system may be implemented across the client devices and/or the server devices such that different portions or components of the T&D system are implemented on different computing devices in the environment. In this way, the environment may be a cloud computing environment, and the T&D system may be implemented across one or more devices of the cloud computing environment in order to leverage the processing capabilities, memory capabilities, connectivity, speed, etc., that such cloud computing environments offer in order to facilitate the features and functionalities described herein.

In some embodiments, a conventional technique for torque and drag (T&D) analysis of a drill string is described. The drill string may include one or more sections, components, and/or downhole tools. The drill string may be implemented (or planned to be implemented) in a wellbore. In many cases, wellbores may be deviated and may exhibit curvature and tortuosity to various degrees. Drill strings may typically be at least somewhat rigid at one or more locations and thus may bend and deform in order to traverse certain portions of a deviated wellbore. Additionally, contact of the drill string with the wellbore may result in frictional resistance to the movement, both rotational and axial, of the drill string in the wellbore. Accordingly, drill strings may experience various stresses, forces, twisting, bending, compression, and tension among other dynamics. Thus, it may be advantageous to determine and assess the dynamics acting on the drill string, for example, to ensure that one or more working or failure limits are not met or exceeded for one or more components of the drill string, and to prevent the drill string from becoming stuck at one or more locations in the wellbore. Determining, characterizing, and/or understanding the dynamics (e.g., forces, friction, torques, etc.) acting on a drill string is what is typically referred to as T&D drag analysis. Thus, while T&D analysis may typically involve determining the torque and/or drag (e.g., axial force) acting on a drill string, the analysis is not limited to only these dynamics and may include determining any other relevant dynamic of interest.

In many cases, T&D analysis may typically be performed by utilizing a finite element analysis (FEA) method. For example, the drill string may be represented, converted, and/or approximated by an FEA model. As is known in the art, finite element modeling is a computational technique utilized to simulate and analyze the behavior of complex structures and systems. For example, based on the principles of discretization, a continuous object, such as the drill string, may be divided into a finite number of smaller, interconnected elements or segments. Each of these elements is defined by a set of mathematical equations, or shape functions, that describe its behavior under simulated, real-world conditions. Conventional techniques may leverage the FEA model in order to perform T&D analysis.

For example, the FEA model may be created by generating a mesh of the drill string. The drill string may be divided into finite elements of simple geometric shapes such as lines, triangles, quadrilaterals, tetrahedra, hexahedra, or other shapes. The elements may take any form such as 1-dimenstional, 2-dimensional, 3-dimensional, and even higher-order elements, and combinations thereof. The generated mesh may also include nodes connecting adjacent finite elements. The mesh of nodes and finite elements may typically be fine enough to capture the details, sections, tools, components, etc. of the drill string.

After the mesh is established, mathematical equations, or shape functions, are defined that govern and/or described the behavior of each element. These equations are derived based on physical principles and material properties of the drill string. For instance, the shape functions may be based on and/or related to stress, strain, and deformation of or within the finite elements. Interaction and/or movement of the nodes may govern the shape functions, and therefore the shape functions of adjacent elements may be coupled based on commonly shared nodes.

The shape functions may describe how the finite elements respond to various loads, boundary conditions, forces, torques, and other dynamics applied to or experienced by the drill string. For example, each element may be associated with properties, material characteristics, etc., of an associated portion of the drill string in order to collectively represent the entire drill string.

The drill string may be subject to various forces which may be incorporated into the FEA model. For instance, one or more axial loads may be applied to the FEA model. The axial loads may represent axial loading of the drill string, such as due to a weigh-on-bit of a downhole tool, a (e.g., suspended) weight of the drill string, a hook load applied by a drill rig, or any other applicable axial force. The axial loads may be associated with stress and/or tension on or within the drill string. One or more lateral, normal, or contact forces may be applied to the FEA model. The contact forces may represent lateral or normal loading of the drill string, such as due to the drill string contacting the wellbore wall at one or more locations (e.g., around a dogleg or bend). The contact forces may influence the tension within the drill string, and may also result in frictional forces (e.g., torsional and axial) exerted on the drill string, such as when the drill string is rotated within the wellbore, or tripped into or out of the wellbore.

Once defined, the shape functions may be assembled into a system of algebraic and/or differential equations that represent the entire global system of the FEA model. Using numerical techniques, the assembled system of equations may be solved to predict the response of the entire system under the specified conditions (e.g., under the applied loads, boundary conditions of the wellbore, etc.). An example shape function may be based on the following formula:

$$K \times U = F_g + F_{cnt}$$

where K=Stiffness of Pipe, U=Displacement of Pipe, $F_g$=Gravitational Force, and $F_{cnt}$=Contact Force Shape functions may be based on and/or may incorporate any other formula, principle, or expression. The FEA model may simulate the rotational and/or axial movement of the drill string within the wellbore by applying torques and/or forces and considering the mechanical connection between the various components/elements. Additionally, various parameters such as diameter, inclination, azimuth, material properties, etc., of the wellbore may be integrated into the FEA model to simulate real-world conditions. By solving the system of equations, the deformation and stress distribution may be calculated within the drill string for providing the torque and/or tension of the drill string at different depths. Additionally, axial and/or torsional drag may be assessed by analyzing the axial forces acting on the drill string as it moves through the wellbore, accounting for factors like wellbore geometry, trajectory, wellbore friction, gravity, buoyancy of the drilling fluid, etc. In this way, the FEA model may capture complex behaviors of the drill string such as buckling, helical deformation, and contact interactions with the wellbore wall in addition to tension and torque on/within the drill string.

In some instances, drill strings may be implemented downhole that have multiple drill string layers at one or more locations. The drill string may be implemented in a wellbore. The liner string may be a casing for cementing to the wellbore and the inner string may extend within the liner string for facilitating implementation or installation of the liner string. Many other situations may implement a drill string having one or more interior or inner sections (e.g., inner downhole tools) that may be applicable to the techniques described herein. For example, a downhole system may implement a BHA or other downhole tools in connection with an inner string for forming a wellbore at or below an outer, liner string.

When the drill string is implemented in a straight and/or vertical section of the wellbore, the inner string may be positioned within the liner string such that they do not contact. In some embodiments, the inner string is coincident or coaxial with the liner string. In this way, no resultant contact forces may be exhibited between the inner string and the liner string. Similarly, in vertical sections of the wellbore, the liner string may not contact the wellbore (e.g., a wellbore wall of the wellbore) such that no resultant contact forces are exhibited between the liner string and the wellbore. However, in a curved or doglegged section of the wellbore, the drill string may be bent or deformed around the curvature of the wellbore and may contact the wellbore. Due to its multi-layer nature, the resulting behavior of the drill string may be defined by a relationship of contact forces between the inner string and the liner string, as well as between the liner string and the wellbore (and/or other resultant inter-string dynamics). The interaction between the inner string and the liner string, including the contact forces, may be complex. For example, when the inner string contacts the inside of the liner string, it may influence the localized friction and resistance of the liner string with respect to the wellbore. However, while the inner string 447 may be connected or fixed to the liner string at one or more locations (e.g., an uphole end of the inner string), the inner string may be somewhat free to move, deform, stretch, compress, etc., within the liner string. Similarly, the liner string may be somewhat free to move, deform, stretch, compress, etc. with respect to the inner string. The contact points between these two layers may accordingly be difficult to predict and characterize accurately. For example, the behavior of the drill string and the relationship between the inner string and the liner string may be functions of the properties, geometry, forces, etc. of the inner string and the liner string each independently, as well as functions of the interaction between the two. Thus, the T&D analysis for a multi-layer drill string greatly increases the complexity and difficulty over that of a single layer drill string.

For example, the drill string may include a landing string from which the liner string and inner string are suspended. An FEA model may be generated for the drill string. For example, a mesh may be generated and may define a series of finite elements joined at nodes. A mesh for each of the landing string, liner string and inner string may be generated, and these meshes may be coupled or linked together based on the interaction between each of these portions of the drill string. For example, the mesh for the liner string may be connected (e.g., rigidly) to the mesh for the landing string, representing the rigid connection between the liner string and landing string. Similarly, the inner string may be connected and/or associated (e.g., rigidly) with the landing string via a rigid link. However, as mentioned above, other than this rigid connection of both the liner string and the inner string with the landing string (and therefore with each other), these two layers may otherwise be substantially independent and may move, deform, stretch, etc., with respect to one another. However, also as mentioned above, there may be some interaction between the inner string and the liner string based on bends in the wellbore causing contact between these nested string layers and between the wellbore. Thus, in order to accurately represent the resultant dynamics, and to perform an adequate T&D analysis, these interactions (e.g., contact between the inner string and liner string) must be represented in the FEA model, which may conventionally be represented by a series of contact elements.

The interaction between the inner string and the liner string with respect to the wellbore presents a highly complex phenomenon which may be very difficult to accurately represent with FEA techniques. For example, defining the shape functions for determining and representing the inter-layer interaction (e.g., the contact elements) may be highly complicated. Indeed, FEA modeling the multi-layer system may involve a high level of non-linearity and may result in significant convergence issues.

For example, the different layers may include different materials, dimensions, shapes, etc., resulting in distinct mechanical properties. The layers may accordingly have distinct elasticity, yield strength, failure modes, etc., which may require advances constitutive models to accurately account for. Further, properties of the layers may be non-uniform and modelling these non-uniformities accurately may require more sophisticated meshing and boundary conditions strategies over that of a single-layer approach. As another example, the FEA model may have to account for friction and/or potential slippage between the two layers which may be computationally difficult. In another example, the different layers may exhibit different modes and/or severity of deformation, including buckling and helical behavior, making modeling the inter-layer interaction more complex. In another example, the nature of the downhole system itself may often involve large deformations, which may challenge traditional FEA techniques and required nonlinear analysis to accurately characterize the large deformations and material nonlinearity. Accounting for multiple, nested layers may result in even more nonlinearity. Finally, in downhole scenarios, boundary conditions may be difficult to define, and the interaction between the two layers and the surrounding geological formations may further complicate the analysis.

Further, even where the FEA model may be accurately constructed and shape functions sufficiently defined, solving such a system may be computationally demanding, even prohibitively so. For example, high-performance computing resources and advances software tools may be required to even solve these complex systems and equations, and even still, the results may not be accurate due to the many variables involve, leading to performance, accuracy, and reliability issues. Thus, modeling and solving a complete, multi-layer FEA model may not be an adequate solution for performing T&D analysis. The techniques of the present disclosure, however, provide benefits over these conventional techniques by performing multiple rounds or processes of single-layer FEA modeling in order to perform an accurate T&D analysis of multi-layer drill strings. The T&D system described herein may utilize the (e.g., conventional) FEA techniques described herein (or any other known FEA techniques) but may do so in a novel way by implementing a unique, virtual wellbore which may enable the T&D system to adequately handle multi-layer drill string problems where conventional techniques fall short.

In some embodiments, an example implementation of the T&D system is described herein, according to at least one embodiment of the present disclosure. The T&D system includes a data manager, a partition manager, and a torque and drag (T&D) analyzer, and a report engine. The T&D system also includes a data storage having wellbore data, drill string data, and report data stored thereon. While one or more embodiments described herein describe features and functionalities performed by specific components of the T&D system, it will be appreciated that specific features described in connection with one component of the T&D system may, in some examples, be performed by one or more of the other components of the T&D system.

By way of example, one or more of the data receiving, gathering, or storing features of the data manager may be delegated to other components of the T&D system. As another example, while the drill string may be partitioned and a virtual wellbore generated by a partition manager, in some instances, some or all of these features may be performed by the T&D analyzer (or anther component of the T&D system). Indeed, it will be appreciated that some or all of the specific components may be combined into other components and specific functions may be performed by one or across multiple components of the T&D system.

Additionally, while the T&D system has been describe as being implemented on a client device of the downhole system, it should be understood that some or all of the features and functionalities of the T&D system may be implemented on or across multiple client devices and/or server devices. For example, data may be input and/or received by the data manager on a (e.g., local) client device, and the torque and drag may be determined by the T&D analyzer on one or more of a remote, server, or cloud device. Indeed, it will be appreciated that some or all of the specific components may be implemented on or across multiple client devices and/or server devices, including individual functions of a specific component being performed across multiple devices.

As mentioned above, the T&D system includes a data manager. The data manager may receive a variety of types of data associated with the downhole system and may store the data to the data storage. The data manager may receive the data from a variety of sources, such as from sensors, surveying tools, downhole tools, other (e.g., client) devices, user input, etc.

In some embodiments, the data manager receives wellbore data for a subject wellbore or a wellbore of interest. For example, the wellbore data may be associated with a wellbore of an active operation of a downhole system (e.g., being actively drilled). In another example the wellbore data may be associated with a wellbore that is being planned, studied, analyzed, or otherwise simulated to determine associated torque(s) and/or drag(s) for the wellbore. In this way, the T&D system may be incorporated with any potential or existing wellbore of interest.

The wellbore data may identify one or more aspects of the wellbore. For example, the wellbore data may identify a trajectory (e.g., planned or actual) of the wellbore throughout one or more (or all) measurement depths. The trajectory may exhibit one or more bends, doglegs and/or curves throughout the length of the wellbore. Indeed, in many cases, wellbores may have trajectories that are highly deviated and exhibit a significant amount of curvature and/or tortuosity. The wellbore data may accurately detail the geometry of the trajectory in order to facilitate the present techniques.

In some embodiments, the wellbore data includes information related to the earth, rock, ground, or formation through which the wellbore traverses. For example, the wellbore data may include geological data, geophysical data, and/or lithology data for the formation(s). The wellbore data may include details related to a rock composition, structure, type, porosity, permeability, pressure, temperature, presence of hydrocarbons or other fluid, or any other property. The wellbore data in this way may facilitate characterizing an interaction between a drill string and the formation, for example, to facilitate determining resultant contact forces and/or frictional forces between the drill string and the formation as described herein. In some embodiments, the wellbore data identifies a coefficient of friction associated with various formations and/or subsurface features in relation to different downhole tools and/or drill strings that may come in to contact with the formations. In this way, the data manager may receive wellbore data that may facilitate characterizing the wellbore. The wellbore data may include any other data associated with and/or relevant to the wellbore, pursuant to the techniques described herein. The data manager may stored the wellbore data to the data storage.

In some embodiments, the data manager receives drill string data for a drill string of interest. For example, the drill string data may be associated with a drill string being actively implemented downhole in an associated wellbore. In another example, the drill string data may be associated with a plan, analysis, or simulation of a drill string to be implemented in a wellbore (e.g., existing or planned wellbore). The drill string data may identify and/or may include information related to one or more downhole tools for implementing downhole and/or including in a drill string. For example, the drill string data may include information related to a BHA, bit, reamer, motor, RSS, stabilizer, collar, tool joint, or any other downhole tool or component connected to or implemented in a drill string. The drill string data may include information related to one or more lengths or sections of the drill string, such as one or more lengths of drill pipe, casing or liner, landing strings, running strings, inner strings, or any other portion or component of a drill string.

The drill string data may identify information about the drill string, such as a geometric configuration and material properties of the drill string and/or drilling tools. For example, the drill string data may identify dimensions of individual drill string components such as the length and diameter of each component. The drill string data may identify a weight, composition, and makeup of drill string components, as well as a specification of tool joints and other connection features. The drill string data may identify dynamic conditions during a downhole operation (e.g., real-time and/or simulated operation), such as weight-on-bit (WOB), rotary speed, drilling fluid properties, surface and/or downhole torque, hook load, or any other dynamics associated with the drill string. The data manager may receive the drill string data through one or more sensors, tools, measurement devices, client devices, or user input. The drill string data may be received by the data manager in real time, for example, during an active downhole operation. The data manager may receive the drill string data as part of a planning or simulation for implementing a drill string in a wellbore. In this way, the data manager may receive the drill string data in order to facilitate characterizing one or more aspects of the drill string. The data manager may store the drill string data to the data manager.

In some embodiments, the data manager receives user input. The data manager may receive the user input, for example, via any of the client devices and/or server devices. Any of the data described herein may be input or augmented via the user input. For example, in some instances, some or all of the wellbore data is received by the data manager as user input. The user input may be received in association with one or more functions or features of the T&D system.

A mentioned above, the T&D system includes a partition manager. The partition manager may facilitate partitioning, decoupling, or otherwise separating the layers or portions of a drill string in order that they may be analyzed in isolation. The drill string may be implemented (or planned to be implemented) in a wellbore. The drill string may include a landing string coupled to a liner string and inner string. The inner string may be positioned within the liner string.

As discussed above, accurately modeling and solving a complete system representing both the liner string and the inner string, including their interaction, may be highly complex and computationally demanding. In some embodiments, the partition manager separates the inner string from the liner string. The partition manager may separate these layers by simulating a set of constraints and/or boundary conditions for the inner string such that it may be analyzed in isolation from the liner string. For example, the partition manager may define or generate a virtual wellbore. Generation of the virtual wellbore may be based on the liner string. For example, the virtual wellbore may be a simulation or approximation of a wellbore that may take the shape and/or form of the inner string. The geometry of the virtual wellbore may be based on the geometry of the liner string. For example, one or more dimensions of the virtual wellbore, such as an inner diameter, may be that of the liner string. The virtual wellbore may have a trajectory, path, orientation, curvature, and/or dogleg based on the liner string. For example, the trajectory/path of the virtual wellbore may be the trajectory/path of the liner string. In another example, the trajectory/path of the virtual wellbore may be the trajectory/path of the wellbore (e.g., the virtual wellbore may be the wellbore but with the inner diameter of the liner string). The virtual wellbore may be constrained and/or determined such that it is fixed, rigid and/or does not move or deviate from the (e.g., curved) trajectory. In other words, for this portion of the analysis, the interaction of the inner string with the liner string (e.g., virtual wellbore) is assumed to have no effect on further deforming the liner string based on the constraining the virtual wellbore as rigid. In this way, the virtual wellbore may simulate or approximate the liner string as a wellbore in which the inner string is situated.

In some embodiments, the association of the inner string to the liner string is approximated based on one or more constraints of the inner string with respect to the virtual wellbore. For example, the inner string may be grounded, fixed, coupled, or otherwise constrained to the virtual wellbore at an upper or uphole end of the inner string. The inner string may be constrained in this way such that, when modelling, the inner string may not be permitted to move laterally, axially, and/or rotationally with respect to the virtual wellbore at the uphole end. This may simulate the connection of the inner string with the landing string. For example, in operation, the inner string may not rotate with respect to the landing string or the liner string (e.g., they may all rotate together) and the inner string may be accordingly constrained to not rotate with respect to the virtual wellbore. In this way, the connection of the inner string to the liner string and the landing string at the uphole end may be simulated.

In some embodiments, the inner string is grounded, fixed, coupled, or otherwise constrained to the virtual wellbore at a lower or downhole end of the inner string. In some embodiments, the inner string is constrained at the downhole end such that it may not be permitted to move laterally, axially, and/or rotationally with respect to the virtual wellbore, similar to the constraint at the uphole end. In some embodiments, the inner string is only constrained laterally at the downhole end, such that the inner string may be permitted to move, stretch, compress, etc. axially and/or rotationally at the downhole end. This lower constraint may simulate a running tool, stabilizer, collar, etc. that may center or fix the inner string (e.g., laterally) with respect to the liner string, or it may be a simplification or assumption for the purposes of modeling.

Based on the virtual wellbore, the partition manager may determine one or more inner forces acting on and/or associated with the inner string. For example, the partition manager may determine an inner axial force. The inner axial force may be based on a weight or hook load of the inner string. The inner axial force may act on or may be associated with the uphole end of the inner string. In this way, the inner axial force may simulate the force experienced by the inner string at or by the connection or coupling of the inner string with the liner string and the landing string.

In some embodiments, the partition manager determines one or more inner contact forces. For example, based on the virtual wellbore, and more specifically based on the geometry or trajectory of the virtual wellbore, the partition manager may determine one or more locations where the inner string may contact the virtual wellbore. The partition manager may accordingly determine inner contact forces at these contact locations. The partition manager may determine a magnitude of the inner contact forces based on the virtual wellbore, inner string tension, etc. In this way, the inner contact forces between the inner string and the virtual wellbore may be generated to simulate the inter-layer interaction between the inner string and the liner string. The partition manager may determine any other force, torque, or other dynamic associated with the inner string as part of the inner forces. For example, the partition manager may determine a frictional force at the contact between the inner string and liner string. In some cases, the partition manager may ignore, negate, or otherwise treat friction as negligible between the inner string and liner string. The partition manager may store the inner forces to the data storage as drill string data to facilitate applying the inner forces with respect to the liner string as discussed herein.

An FEA model may be generated for the inner string in isolation as discussed above. The FEA model may be generated based on the boundary conditions, constrains, and virtual wellbore discussed above. For example, the finite elements, nodes, shape functions, etc., may be defined and analyzed based on the simulated conditions of the inner string with respect to the virtual wellbore. In this way, the inner string may be analyzed independent of the liner string 648 and the landing string based on the FEA model. The FEA model may be generated and/or solved by the partition manager and/or the T&D analyzer described in more detail below. The FEA model may be a simpler model to solve, for example in contrast to the complex multi-layer approach discussed above, due to the FEA model including the single layer inner string simulated inside of the virtual wellbore.

Similar to separating the inner string from the liner string, the partition manager may facilitate analyzing the liner string in isolation. For example, the partition manager may simulate the liner string without the inner string. The partition manager may simulate the liner string implemented within the wellbore and connected to the landing string, if applicable (e.g., in some instances, no landing string may be implemented such as if the liner string, or other equivalent outer string component, extends from the surface).

In some embodiments, the partition manager incorporates one or more constraints or boundary conditions. For example, the landing string (or liner string) may be grounded, fixed, or otherwise constrained to a top of the wellbore or to the surface. The constraint may be such that, when modelling, the landing string and/or the liner string may be fixed rotationally, fixed axially, or fixed laterally, and combinations thereof. This may simulate the connection of the liner string and landing string with the surface, such as a coupling to a drill rig or other surface component.

In some embodiments, the partition manager incorporates one or more of the determined inner forces from the inner string as applied forces to the liner string and/or landing string. For example, the partition manager may apply the inner axial force as a force (e.g., equal and opposite reaction force) to the modelling of the liner string and/or landing string. This may simulate the downward force (e.g., weight) of the inner string exerted at the connection of the liner string and landing string. In another example, the partition manager may apply the inner contact forces as reaction forces to the liner string in order to simulate the contact points where the inner string and liner string interact. Any other forces, torques, or other dynamics determined with respect to the inner string may be incorporated and applied to the liner string and/or landing string.

An FEA model may be generated for the liner string in isolation as discussed above. The FEA model may be generated based on the boundary conditions, constrains, and/or simulations discussed above. For example, finite elements, nodes, shape functions, etc., may be defined and analyzed based on the simulated conditions of the liner string with respect to the wellbore. In this way, the liner string may be analyzed independent of the inner string based on the FEA model. The FEA model may incorporate the inner forces of the inner string as applied forces to the liner string and/or landing string. For example, the determined inner forces from the inner string may be applied to one or more nodes and/or elements of the liner string. The FEA model may incorporate other applied forces as well. For example, the FEA model may incorporate forces associated with a downhole tool, such as a WOB. The WOB may be an applied axial force to a downhole portion or end of the liner string. In another example, the FEA model may incorporate a hookload associated with a weight of the landing string and/or liner string. The FEA model may incorporate one or more torques, such as a surface torque applied by a drill rig or other surface component. The FEA model may incorporate any other force, torque, or other dynamic relevant to the T&D analysis of the drill string. In this way, the FEA model may be a single-layer FEA model associated with the liner string but may incorporate and/or apply dynamics from the FEA model for the inner string in order to characterize and account for the interaction between the inner string and the liner string.

As mentioned above, the T&D system includes a T&D analyzer. The T&D analyzer may solve one or more of the FEA models. For example, the T&D analyzer may facilitate determining the inner force of the inner string associated with the FEA model for the inner string. In another example, the T&D analyzer may solve the FEA model for the liner string in order to determine one or more dynamics associated with the liner string. For example, the T&D analyzer may determine, based on the FEA model including the applied inner force, one or more normal forces between the liner string and the wellbore. The normal forces may be forces associated with areas where the liner string makes contact with the wellbore, such as through a curve or dogleg of the wellbore. Additionally, the T&D analyzer may determine one or more normal forces between the landing string and the wellbore where applicable. The normal forces may be based on and/or influenced by the tension within the liner string and/or landing string pulling the liner string against the wellbore. Additionally, the normal forces may be affected by the inner string contacting the liner string and further pressing the liner string against the wellbore. The normal forces may result in frictional resistance by the wellbore to the movement of the drill string, for example, as the drill string is rotated and/or tripped into or out of the wellbore. In this way the normal forces may influence or affect the torque and drag experienced by the drill string. For example, frictional forces resultant from the normal forces may increase the axial tension in one or more portions of the drill string as it is pulled out of, or advanced into the wellbore. In another example, the frictional forces may increase the torque experienced by the drill string as it is rotated within the wellbore. Thus, the normal forces may be valuable metrics for determining T&D dynamics of the drill string, and the T&D analyzer may facilitate determine the normal forces.

In this way, T&D analyzer may determine T&D metrics and dynamics for the multi-layered drill string by solving and/or utilizing single layer FEA models. For example, the T&D analyzer may determine one or more of a torque, axial drag, tension, compression, contact, friction, buckling, helical deformation, downhole equipment behavior, or any other associated T&D measure at one or more locations of the drill string. Implementing the FEA models each as separate, single-layer models is significant in that it allows conventional FEA techniques to be implemented to solve the complex problems of a multi-layered drill string by defining and incorporating the unique boundary conditions and constrains of the virtual wellbore, and applying the relevant dynamics from the inner string to the liner string. The T&D analyzer may store any of the determined metrics or dynamics to the data storage as drill string data.

As mentioned above, the T&D system includes a report engine. The report engine may generate and/or present one or more reports associated with the T&D analysis described above. The report may illustrate one or plots associated with one or more T&D dynamics, such as tension and torque. The report may include and/or plot any other associated T&D dynamic. The report may represent determined T&D dynamics for various downhole conditions, such as for different situations or operations of the downhole system. The report may indicate a baseline torque and/or drag (e.g., zero friction) associated with the drill string being static in the wellbore. The report may indicate a torque and/or drag associated with advancing the drill string into and/or tripping the drill string out of the wellbore. The report may indicate a torque and/or drag associated with rotating the drill string in the wellbore, which may be in conjunction with pulling the drill string out of the wellbore. The report may indicate a torque and/or drag associated with backreaming with a downhole tool as the drill string is being removed from the wellbore. The report may indicated any other T&D dynamic determined by the T&D system, and may represent any dynamic with respect to any other relevant situation, condition, or operation of the downhole system. In some embodiments, the report engine presents the report via a graphical user interface of a user device. The report engine may store the report to the data storage as report data.

In some embodiments, the report engine generates a report for T&D analysis of a multi-layer drill string with respect to a vertical wellbore. The report may present and/or plot a tension of the drill string through a range of measurement depths. Additionally, or alternatively, the be in relation to any other T&D dynamic, such as torque.

The report may present two different representations of tension in the drill string. One plot may be a representation of the determined tension throughout the drill string without accounting for the inner string, such as based on a simplified, single-layer model of just the liner string. Another plot, however, may be based on the techniques discussed herein, and may represent the tension throughout the drill string taking into account the inner string and interaction between the inner string and liner string, as discussed herein. The tension or hookload determined for the drill string may be the same in both cases at a point below where the inner string is coupled to the liner string and landing string. This may be due to the fact that the inner string and liner string hanging vertically may not interact in a completely vertical well. However, in the inner string plot, the tension may be offset at a point where the inner string is connected to the landing string. Indeed, the hookload observed at the surface may reflect this offset and may account for a difference of nearly 25 klbf when accounting for the inner string. In this way, they report illustrates the increased accuracy and precision of the present modeling techniques.

In some embodiments, the report is associated with a T&D analysis of a multi-layer drill string with respect to a wellbore having an incline. The report may be associated with a simulation of a wellbore having an incline, such as 30 degrees. While the drill string tension for the vertical wellbore in the (vertical) report described above may be unaffected by the inner string below a point where the inner string is coupled to the landing string, in the (inclined) report, the interaction between the inner string and the liner string may, in an inclined wellbore, influence the drill string tension. For example, the inner contact forces between the inner string and the liner string may increase the frictional force exerted on the liner string by the wellbore, thereby reducing the tension in the drill string. This may be a simplified example to illustrate the advantages provided by the techniques described herein, and more highly deviated wells may benefit to a further extent from the increased accuracy and precision provided by the T&D system. The report engine may store the report to the data storage as report data.

In some embodiments, a method or a series of acts is described for analyzing torque and drag of a drill string in a wellbore as described herein, according to at least one embodiment of the present disclosure.

In some embodiments, the method includes an act of receiving wellbore data including a trajectory of the wellbore at a range of measurement depths of interest.

In some embodiments, the method includes an act of receiving drill string data for the drill string, at least a portion of the drill string including an inner string positioned inside of the drill string. The drill string may include a liner string connected to a downhole end of a landing string. The inner string may be positioned inside of the liner string. The liner string may be a casing for cementing to the wellbore. The drill string data may identify properties of the drill string.

In some embodiments, the method includes an act of generating a virtual wellbore associated with the inner string based on an inner diameter of the drill string and based on the trajectory of the wellbore.

In some embodiments, the method includes an act of determining a set of inner forces for the inner string. For example, the inner forces may include an axial force based on a weight of the inner string and a set of contact forces between the inner string and the virtual wellbore. In some embodiments, the T&D system determines the set of inner forces based on simulating an axial load applied to the drill string to pull the drill string out of the wellbore or advance the drill string into the wellbore. The T&D system may determine the set of inner forces based on simulating a torque applied to the drill string to rotate the drill string within the wellbore. In some embodiments, the T&D system determines the set of inner forces based on constraining a downhole end of the inner string to be laterally fixed with respect to the virtual wellbore. The T&D system may determine the set of inner forces based on constraining an uphole end of the inner string to be axially, laterally, and rotationally fixed with respect to the virtual wellbore. The set of inner forces may be determined based on ignoring friction between the inner string and the drill string.

In some embodiments, the method includes an act of identifying a set of normal forces between the drill string and the wellbore based on simulating the axial forces and the set of contact forces as applied forces to the drill string. In some embodiments, the T&D system identifies the set of normal forces based on simulating an axial load applied to the drill string to pull the drill string out of the wellbore or advance the drill string into the wellbore. The T&D system may identify the set of normal forces based on simulating a torque applied to the drill string to rotate the drill string within the wellbore. In some embodiments, the set of normal forces between the drill string and the wellbore is identified independent of determining the set of inner forces of the inner string. For example, the set of inner forces may be determined based on a first single-layer finite element analysis (FEA) model and the set of normal forces may be identified based on a second single-layer FEA model.

In some embodiments, the T&D system determines one or more axial frictional forces acting on the drill string at one or more measurement depths based on the set of normal forces. The T&D system may also determine an axial tension of the drill string at one or more locations based on the axial frictional forces and may generate a plot of the axial tension of the drill string at one or more of the measurement depths of interest. In some embodiments, the T&D system determines one or more torsional frictional forces acting on the drill string at one or more measurement depths based on the set of normal forces. T&D system may also determine a torque of the drill string at one or more locations based on the torsional frictional forces and may generate a plot of the torque of the drill string at one or more of the measurement depths of interest.

In some embodiments, certain components may be included within a computer system. One or more computer systems may be used to implement the various devices, components, and systems described herein.

The computer system includes a processor. The processor may be a general-purpose single- or multi-chip microprocessor (e.g., an Advanced RISC (Reduced Instruction Set Computer) Machine (ARM)), a special purpose microprocessor (e.g., a digital signal processor (DSP)), a microcontroller, a programmable gate array, etc. The processor 1001 may be referred to as a central processing unit (CPU). Although just a single processor is described, in an alternative configuration, a combination of processors (e.g., an ARM and DSP) could be used.

The computer system also includes memory in electronic communication with the processor. The memory may include computer-readable storage media and may be any available media that may be accessed by a general purpose or special purpose computer system. Computer-readable media that store computer-executable instructions are non-transitory computer-readable media (device). Computer-readable media that carry computer-executable instructions are transmission media. Thus, by way of example and not limitations, embodiment of the present disclosure may comprise at least two distinctly different kinds of computer-readable media: non-transitory computer-readable media (devices) and transmission media.

Both non-transitory computer-readable media (devices) and transmission media may be used temporarily to store or carry software instructions in the form of computer readable program code that allows performance of embodiments of the present disclosure. Non-transitory computer-readable media may further be used to persistently or permanently store such software instructions. Examples of non-transitory computer-readable storage media include physical memory (e.g., RAM, ROM, EPROM, EEPROM, etc.), optical disk storage (e.g., CD, DVD, HDDVD, Blu-ray, etc.), storage devices (e.g., magnetic disk storage, tape storage, diskette, etc.), flash or other solid-state storage or memory, or any other non-transmission medium which may be used to store program code in the form of computer-executable instructions or data structures and which may be accessed by a general purpose or special purpose computer, whether such program code is stored or in software, hardware, firmware, or combinations thereof.

Instructions and data may be stored in the memory. The instructions may be executable by the processor to implement some or all of the functionality disclosed herein. Executing the instructions may involve the use of the data that is stored in the memory. Any of the various examples of modules and components described herein may be implemented, partially or wholly, as instructions stored in memory and executed by the processor. Any of the various examples of data described herein may be among the data that is stored in memory and used during execution of the instructions by the processor.

A computer system may also include one or more communication interfaces for communicating with other electronic devices. The communication interface(s) may be based on wired communication technology, wireless communication technology, or both. Some examples of communication interfaces include a Universal Serial Bus (USB), an Ethernet adapter, a wireless adapter that operates in accordance with an Institute of Electrical and Electronics Engineers (IEEE) 802.11 wireless communication protocol, a Bluetooth® wireless communication adapter, and an infrared (IR) communication port.

The communication interfaces may connect the computer system to a network. A "network" or "communications network" may generally be defined as one or more data links that enable the transport of electronic data between computer systems and/or modules, engines, or other electronic devices, or combinations thereof. When information is transferred or provided over a communication network or another communications connection (either hardwired, wireless, or a combination of hardwired or wireless) to a computing device, the computing device properly views the connection as a transmission medium. Transmission media may include a communication network and/or data links, carrier waves, wireless signals, and the like, which may be used to carry desired program or template code means or instructions in the form of computer-executable instruction or data structures and which may be accessed by a general purpose or special purpose computer.

A computer system may also include one or more input devices and one or more output devices. Some examples of input devices include a keyboard, mouse, microphone, remote control device, button, joystick, trackball, touchpad, and lightpen. Some examples of output devices include a speaker and a printer. One specific type of output device that is typically included in a computer system is a display device. Display devices used with embodiments disclosed herein may utilize any suitable image projection technology, such as liquid crystal display (LCD), light-emitting diode (LED), gas plasma, electroluminescence, or the like. A display controller may also be provided, for converting data stored in the memory into one or more of text, graphics, or moving images (as appropriate) shown on the display device.

The various components of the computer system may be coupled together by one or more buses, which may include one or more of a power bus, a control signal bus, a status signal bus, a data bus, other similar components, or combinations thereof. For the sake of clarity, the various buses are described as a bus system.

The techniques described herein may be implemented in hardware, software, firmware, or any combination thereof, unless specifically described as being implemented in a specific manner. Any features described as modules, components, or the like may also be implemented together in an integrated logic device or separately as discrete but interoperable logic devices. If implemented in software, the techniques may be realized at least in part by a non-transitory processor-readable storage medium comprising instructions that, when executed by at least one processor, perform one or more of the methods described herein. The instructions may be organized into routines, programs, objects, components, data structures, etc., which may perform particular tasks and/or implement particular data types, and which may be combined or distributed as desired in various embodiments.

Further, upon reaching various computer system components, program code in the form of computer-executable instructions or data structures may be transferred automatically or manually from transmission media to non-transitory computer-readable storage media (or vice versa). For example, computer executable instructions or data structures received over a network or data link may be buffered in memory (e.g., RAM) within a network interface module (NIC), and then eventually transferred to computer system RAM and/or to less volatile non-transitory computer-readable storage media at a computer system. Thus, it should be understood that non-transitory computer-readable storage media may be included in computer system components that also (or even primarily) utilize transmission media.

The following description from ¶¶ [0159]-[0178] includes various embodiments that, where feasible, may be combined in any permutation. For example, the embodiment of ¶ [0159] may be combined with any or all embodiments of the following paragraphs. Embodiments that describe acts of a method may be combined with embodiments that describe, for example, systems and/or devices. Any permutation of the following paragraphs is considered to be hereby disclosed for the purposes of providing "unambiguously derivable support" for any claim amendment based on the following paragraphs. Furthermore, the following paragraphs provide support such that any combination of the following paragraphs would not create an "intermediate generalization."

In some embodiments, a method of analyzing torque and drag of a drill string in a wellbore includes receiving wellbore data including a trajectory of the wellbore at a range of measurement depths of interest. The method further includes receiving drill string data for the drill string, at least a portion of the drill string including an inner string positioned inside of the drill string. The method further includes generating a virtual wellbore associated with the inner string based on an inner diameter of the drill string and based on the trajectory of the wellbore. The method further includes determining a set of inner forces for the inner string, including an axial force based on a weight of the inner string, and a set of contact forces between the inner string and the virtual wellbore. The method further includes identifying a set of normal forces between the drill string and the wellbore based on simulating the axial force and the set of contact forces as applied forces to the drill string.

In some embodiments, the method includes determining one or more axial frictional forces acting on the drill string at one or more measurement depths based on the set of normal forces.

In some embodiments, the method includes determining an axial tension of the drill string at one or more locations based on the axial frictional forces.

In some embodiments, the method includes generating a plot of the axial tension of the drill string at one or more of the measurement depths of interest.

In some embodiments, the method includes determining one or more torsional frictional forces acting on the drill string at one or more measurement depths based on the set of normal forces.

In some embodiments, the method includes determining a torque of the drill string at one or more locations based on the torsional frictional forces.

In some embodiments, the method includes generating a plot of the torque of the drill string at one or more of the measurement depths of interest.

In some embodiments, the method includes determining the set of inner forces and identifying the set of normal forces includes simulating an axial load applied to the drill string to pull the drill string out of the wellbore.

In some embodiments, determining the set of inner forces and identifying the set of normal forces includes simulating an axial load applied to the drill string to advance the drill string into the wellbore.

In some embodiments, the determining the set of inner forces and identifying the set of normal forces includes simulating a torque applied to the drill string to rotate the drill string within the wellbore.

In some embodiments, determining the set of inner forces includes constraining a downhole end of the inner string to be laterally fixed with respect to the virtual wellbore.

In some embodiments, determining the set of inner forces includes constraining an uphole end of the inner string to be axially, laterally, and rotationally fixed with respect to the virtual wellbore.

In some embodiments, the set of normal forces between the drill string and the wellbore is identified independent of determining the set of inner forces of the inner string.

In some embodiments, determining the set of inner forces is based on a first single-layer finite element analysis (FEA) model, and identifying the set of normal forces is based on a second single-layer FEA model.

In some embodiments, determining the set of inner forces includes ignoring friction between the inner string and the drill string.

In some embodiments, drill string includes a liner string connected to a downhole end of a landing string, and wherein the inner string is positioned inside of the liner string.

In some embodiments, the liner string is a casing for cementing to the wellbore.

In some embodiments, the drill string data identifies properties of the drill string.

In some embodiments, a system includes at least one processor, memory in electronic communication with the at least one processor, and instructions stored thereon in the memory, the instructions being executable by the at least one processor to receive wellbore data including a trajectory of the wellbore at a range of measurement depths of interest. In some embodiments, the instructions are executable by the at least one processor to receive drill string data for the drill string, at least a portion of the drill string including an inner string positioned inside of the drill string. In some embodiments, the instructions are executable by the at least one processor to generate a virtual wellbore associated with the inner string based on an inner diameter of the drill string and based on the trajectory of the wellbore. In some embodiments, the instructions are executable by the at least one processor to determine a set of inner forces for the inner string, including an axial force based on a weight of the inner string, and a set of contact forces between the inner string and the virtual wellbore. In some embodiments, the instructions are executable by the at least one processor to identify a set of normal forces between the drill string and the wellbore based on simulating the axial force and the set of contact forces as applied forces to the drill string.

In some embodiments, a computer-readable storage medium includes instructions that, when executed by at least one processor, cause the processor to receive wellbore data including a trajectory of the wellbore at a range of measurement depths of interest. In some embodiments, the instructions cause the processor to receive drill string data for the drill string, at least a portion of the drill string including an inner string positioned inside of the drill string. In some embodiments, the instructions cause the processor to generate a virtual wellbore associated with the inner string based on an inner diameter of the drill string and based on the trajectory of the wellbore. In some embodiments, the instructions cause the processor to determine a set of inner forces for the inner string, including an axial force based on a weight of the inner string, and a set of contact forces between the inner string and the virtual wellbore. In some embodiments, the instructions cause the processor to identify a set of normal forces between the drill string and the wellbore based on simulating the axial force and the set of contact forces as applied forces to the drill string.

The embodiments of the T&D system have been primarily described with reference to wellbore drilling operations; the T&D system described herein may be used in applications other than the drilling of a wellbore. In other embodiments, the T&D system according to the present disclosure may be used outside a wellbore or other downhole environment used for the exploration or production of natural resources. For instance, the T&D system of the present disclosure may be used in a borehole used for placement of utility lines. Accordingly, the terms "wellbore," "borehole" and the like should not be interpreted to limit tools, systems, assemblies, or methods of the present disclosure to any particular industry, field, or environment.

One or more specific embodiments of the present disclosure are described herein. These described embodiments are examples of the presently disclosed techniques. Additionally, in an effort to provide a concise description of these embodiments, not all features of an actual embodiment may be described in the specification. It should be appreciated that in the development of any such actual implementation, as in any engineering or design project, numerous embodiment-specific decisions will be made to achieve the developers' specific goals, such as compliance with system-related and business-related constraints, which may vary from one embodiment to another. Moreover, it should be appreciated that such a development effort might be complex and time consuming, but would nevertheless be a routine undertaking of design, fabrication, and manufacture for those of ordinary skill having the benefit of this disclosure.

Additionally, it should be understood that references to "one embodiment" or "an embodiment" of the present disclosure are not intended to be interpreted as excluding the existence of additional embodiments that also incorporate the recited features. For example, any element described in relation to an embodiment herein may be combinable with any element of any other embodiment described herein. Numbers, percentages, ratios, or other values stated herein are intended to include that value, and also other values that are "about" or "approximately" the stated value, as would be appreciated by one of ordinary skill in the art encompassed by embodiments of the present disclosure. A stated value should therefore be interpreted broadly enough to encompass values that are at least close enough to the stated value to perform a desired function or achieve a desired result. The stated values include at least the variation to be expected in a suitable manufacturing or production process, and may include values that are within 5%, within 1%, within 0.1%, or within 0.01% of a stated value.

A person having ordinary skill in the art should realize in view of the present disclosure that equivalent constructions do not depart from the spirit and scope of the present disclosure, and that various changes, substitutions, and alterations may be made to embodiments disclosed herein without departing from the spirit and scope of the present disclosure. Equivalent constructions, including functional "means-plus-function" clauses are intended to cover the structures described herein as performing the recited function, including both structural equivalents that operate in the same manner, and equivalent structures that provide the same function. It is the express intention of the applicant not to invoke means-plus-function or other functional claiming for any claim except for those in which the words 'means for' appear together with an associated function. Each addition, deletion, and modification to the embodiments that falls within the meaning and scope of the claims is to be embraced by the claims.

The terms "approximately," "about," and "substantially" as used herein represent an amount close to the stated amount that is within standard manufacturing or process tolerances, or which still performs a desired function or achieves a desired result. For example, the terms "approximately," "about," and "substantially" may refer to an amount that is within less than 5% of, within less than 1% of, within less than 0.1% of, and within less than 0.01% of a stated amount. Further, it should be understood that any directions or reference frames in the preceding description are merely relative directions or movements. For example, any references to "up" and "down" or "above" or "below" are merely descriptive of the relative position or movement of the related elements.

The present disclosure may be embodied in other specific forms without departing from its spirit or characteristics. The described embodiments are to be considered as illustrative and not restrictive. The scope of the disclosure is, therefore, indicated by the appended claims rather than by the foregoing description. Changes that come within the meaning and range of equivalency of the claims are to be embraced within their scope.

What is claimed is:

1. A method of analyzing torque and drag of a drill string in a wellbore, comprising:

receiving wellbore data including a trajectory of the wellbore at a range of measurement depths of interest;

receiving drill string data for the drill string, the drill string data identifying components that make up the drill string, the components including a liner string and an inner string positioned inside of the liner string, the drill string data further identifying geometry and material properties of the components;

solving a first single-layer finite element analysis (FEA) model for the inner string without the liner string, comprising:

generating a virtual wellbore associated with the inner string based on an inner diameter of the liner string and based on the trajectory of the wellbore;

constraining the virtual wellbore to be rigid and fixed along the trajectory of the wellbore;

applying one or more inner boundary conditions for the inner string including constraining an uphole end of the inner string to be fixed with respect to the virtual wellbore;

determining an inner axial force for the inner string based on a weight of the inner string; and determining, based on the trajectory of the virtual wellbore, a set of inner contact forces on the inner string at one or more locations where the inner string contacts the virtual wellbore; and solving a second single-layer FEA model for the liner string without the inner string, comprising:

applying one or more liner boundary conditions to the liner string, including fixing the liner string at a top of the wellbore;

applying a set of applied forces to the liner string, the set of applied forces including the inner axial force and a set of reaction forces corresponding to the set of inner contact forces on the inner string; and identifying, based on the set of applied forces, a set of normal forces between the drill string and the wellbore;

simulating a movement of the drill string in the wellbore to determine, using the set of normal forces, one or more axial frictional forces and one or more torsional frictional forces acting on the drill string during the movement of the drill string, the movement representing a wellbore operation including at least one of pulling the drill string out of the wellbore, advancing the drill string into the wellbore, or rotating the drill string within the wellbore;

simulating axial tension of the drill string based on the one or more axial frictional forces;

simulating torque of the drill string based on the one or more torsional frictional forces;

identifying, based on the drill string data, one or more working limits for one or more components of the components that make up the drill string; and predicting whether the wellbore operation will cause the one or more working limits to be met or exceeded for the one or more components based on the axial tension and the torque.

2. The method of claim 1, further comprising generating a plot of the axial tension of the drill string at one or more measurement depths of the range of measurement depths of interest.

3. The method of claim 1, further comprising generating a plot of the torque of the drill string at one or more measurement depths of the range of measurement depths of interest.

4. The method of claim 1, wherein determining the set of inner contact forces and identifying the set of normal forces includes simulating an axial load applied to the drill string to pull the drill string out of the wellbore.

5. The method of claim 1, wherein determining the set of inner contact forces and identifying the set of normal forces includes simulating an axial load applied to the drill string to advance the drill string into the wellbore.

6. The method of claim 1, wherein determining the set of inner contact forces and identifying the set of normal forces includes the simulating of the torque.

7. The method of claim 1, wherein solving the first single-layer FEA model further includes constraining a downhole end of the inner string to be laterally fixed with respect to the virtual wellbore.

8. The method of claim 1, wherein constraining the uphole end of the inner string to be fixed includes constraining the uphole end of the inner string to be axially, laterally, and rotationally fixed with respect to the virtual wellbore.

9. The method of claim 1, wherein the set of normal forces between the drill string and the wellbore is identified independent of determining the set of inner contact forces of the inner string.

10. The method of claim 1, wherein determining the set of inner contact forces includes ignoring friction between the inner string and the drill string.

11. The method of claim 1, wherein the liner string is connected to a downhole end of a landing string.

12. The method of claim 11, wherein the liner string is a casing for cementing to the wellbore.

13. A system, comprising:

at least one processor:

memory in electronic communication with the at least one processor; and instructions stored thereon in the memory, the instructions being executable by the at least one processor to:

receive wellbore data including a trajectory of a wellbore at a range of measurement depths of interest;

receive drill string data for a drill string, the drill string data identifying components that make up the drill string, the components including a liner string and an inner string positioned inside of the liner string, the drill string data further identifying geometry and material properties of the components;

solve a first single-layer finite element analysis (FEA) model for the inner string without the liner string, comprising:

generate a virtual wellbore associated with the inner string based on an inner diameter of the liner string and based on the trajectory of the wellbore;

constrain the virtual wellbore to be rigid and fixed along the trajectory of the wellbore;

apply one or more inner boundary conditions for the inner string including constraining an uphole end of the inner string to be fixed with respect to the virtual wellbore;

determine an inner axial force for the inner string based on a weight of the inner string; and determine, based on the trajectory of the virtual wellbore, a set of inner contact forces on the inner string at one or more locations where the inner string contacts the virtual wellbore; and solve a second single-layer FEA model for the liner string without the inner string, comprising:

apply one or more liner boundary conditions to the liner string, including fixing the liner string at a top of the wellbore;

apply a set of applied forces to the liner string, the set of applied forces including the inner axial force and a set of reaction forces corresponding to the set of inner contact forces on the inner string; and identify, based on the set of applied forces, a set of normal forces between the drill string and the wellbore;

simulate a movement of the drill string in the wellbore to determine, using the set of normal forces, one or more axial frictional forces and one or more torsional frictional forces acting on the drill string during the movement of the drill string, the movement representing a wellbore operation including at least one of pulling the drill string out of the wellbore, advancing the drill string into the wellbore, or rotating the drill string within the wellbore;

simulate axial tension of the drill string based on the one or more axial frictional forces;

simulate torque of the drill string based on the one or more torsional frictional forces;

identify, based on the drill string data, one or more working limits for one or more components of the components that make up the drill string; and predict whether the wellbore operation will cause the one or more working limits to be met or exceeded for the one or more components based on the axial tension and the torque.

14. A computer-readable storage medium including instructions that, when executed by at least one processor, cause the processor to:

receive wellbore data including a trajectory of a wellbore at a range of measurement depths of interest;

receive drill string data for a drill string, the drill string data identifying components that make up the drill string, the components including a liner string and an inner string positioned inside of the liner string, the drill string data further identifying geometry and material properties of the components;

solve a first single-layer finite element analysis (FEA) model for the inner string without the liner string, comprising:

generate a virtual wellbore associated with the inner string based on an inner diameter of the liner string and based on the trajectory of the wellbore;

constrain the virtual wellbore to be rigid and fixed along the trajectory of the wellbore;

apply one or more inner boundary conditions for the inner string including constraining an uphole end of the inner string to be fixed with respect to the virtual wellbore;

determine an inner axial force for the inner string based on a weight of the inner string; and determine, based on the trajectory of the virtual wellbore, a set of inner contact forces on the inner string at one or more locations where the inner string contacts the virtual wellbore; and solve a second single-layer FEA model for the liner string without the inner string, comprising:

apply one or more liner boundary conditions to the liner string, including fixing the liner string at a top of the wellbore;

apply a set of applied forces to the liner string, the set of applied forces including the inner axial force and a set of reaction forces corresponding to the set of inner contact forces on the inner string; and identify, based on the set of applied forces, a set of normal forces between the drill string and the wellbore;

wherein solving the first and second single-layer FEA models includes solving the first and second single-layer FEA models without solving a multilayer FEA model of the inner string and the liner string;

simulate a movement of the drill string in the wellbore to determine, using the set of normal forces, one or more axial frictional forces and one or more torsional frictional forces acting on the drill string during the movement of the drill string, the movement representing a wellbore operation including at least one of pulling the drill string out of the wellbore, advancing the drill string into the wellbore, or rotating the drill string within the wellbore;

simulate axial tension of the drill string based on the one or more axial frictional forces;

simulate torque of the drill string based on the one or more torsional frictional forces;

identify, based on the drill string data, one or more working limits for one or more components of the components that make up the drill string; and predict whether the wellbore operation will cause the one or more working limits to be met or exceeded for the one or more components based on the axial tension and the torque.

15. The method of claim 1, further comprising solving the first single-layer FEA model and solving the second single-layer FEA model without solving a multilayer FEA model of the inner string and the liner string.

* * * * *